US010073419B2

(12) United States Patent
Lider et al.

(10) Patent No.: US 10,073,419 B2
(45) Date of Patent: Sep. 11, 2018

(54) PHYSICAL WATCH HANDS FOR A COMPUTERIZED WATCH

(71) Applicant: Google Inc., Mountain View, CA (US)

(72) Inventors: Brett Lider, San Francisco, CA (US); Melissa Frank, Los Altos, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/701,862

(22) Filed: Sep. 12, 2017

(65) Prior Publication Data

US 2018/0004166 A1 Jan. 4, 2018

Related U.S. Application Data

(63) Continuation of application No. 15/097,835, filed on Apr. 13, 2016, now Pat. No. 9,791,833.

(51) Int. Cl.

| | |
|---|---|
| ***G04C 17/00*** | (2006.01) |
| ***G04B 19/04*** | (2006.01) |
| ***G04G 9/00*** | (2006.01) |

(52) U.S. Cl.

CPC ..... *G04C 17/0091* (2013.01); *G04B 19/04* (2013.01); *G04G 9/00* (2013.01); *G04G 9/0064* (2013.01); *G04G 9/0082* (2013.01)

(58) Field of Classification Search

CPC .... G04C 17/0091; G04G 9/00; G04G 9/0064; G04G 9/0082

See application file for complete search history.

(56) References Cited

U.S. PATENT DOCUMENTS

| | | | |
|---|---|---|---|
| 4,601,585 | A | 7/1986 | Farley |
| 4,712,924 | A | 12/1987 | Agostini |
| 5,280,461 | A | 1/1994 | Belik |
| 5,696,740 | A | 12/1997 | Inabinet |
| 6,521,822 | B2 | 2/2003 | Ito et al. |
| 6,809,992 | B1 | 10/2004 | Ermel et al. |
| 9,348,320 | B1 | 5/2016 | Defazio et al. |
| 2002/0109808 | A1 | 8/2002 | Sekiguchi et al. |
| 2006/0120222 | A1 | 6/2006 | Mazzetti |

(Continued)

OTHER PUBLICATIONS

Combined Search and Examination Report & Intention to Grant from counterpart German Application No. 1709007.7, dated Jun. 30, 2017, 3 pp.

(Continued)

*Primary Examiner* — Vit W Miska

(74) *Attorney, Agent, or Firm* — Shumaker & Sieffert, P.A.

(57) ABSTRACT

A computerized watch is described that includes a cover that forms an outer surface of the computerized watch, a screen configured to output graphical information for display, a set of physical watch hands positioned between the cover and the screen and configured to present a time of day. One or more computer processors and a memory comprising instructions. The instructions, when executed, cause the one or more computer processors to responsive to determining that the computerized watch is operating in a time display mode, manipulate the set of physical watch hands such that the set of physical watch hands present the time of day by obscuring a portion of a display region of the screen, and responsive to determining that the computerized watch is not operating in the time display mode, manipulate the set of physical watch hands such that the set of physical hands do not obscure the screen.

20 Claims, 14 Drawing Sheets

(56) References Cited

U.S. PATENT DOCUMENTS

| | | | |
|---|---|---|---|
| 2007/0274161 | A1 | 11/2007 | Rydgren |
| 2008/0151700 | A1 | 6/2008 | Inoue et al. |
| 2008/0198702 | A1 | 8/2008 | Meister et al. |
| 2016/0306328 | A1 | 10/2016 | Ko et al. |

OTHER PUBLICATIONS

Jacobsen, "19 Cool Watches that Require a PhD to tell Time," Cool Material, Retrieved from <http://coolmaterial.com/style/19-cool-watches-that-require-a-phd-to-tell-time/> Feb. 26, 2016, 14 pgs.

Larsen, "Kairos Watches Are Half Smartwatch Half Mechanical Watch," Paste Magazine, Retrieved from <http://www.pastemagazine.com/articles/2014/11/kairos-watches-are-half-smartwatch-half-mechanical.html> Nov. 4, 2014, 1 pg.

Tokyoflash Japan Product Design Studio, "AD 1224—An e-paper/LCD combined with analog watch," Tokyoflash Japan Product Design Studio, Retrieved from <http://blog.tokyoflash.com/2012/08/24/ad-1224-an-e-paperlcd-combined-with-analog-watch/> Aug. 24, 2012, 8 pgs.

PHYSICAL WATCH HANDS FOR A COMPUTERIZED WATCH

RELATED APPLICATION

This application is a continuation of U.S. application Ser. No. 15/097,835, filed Apr. 13, 2016, the entire content of which is hereby incorporated by reference.

BACKGROUND

A computerized watch may display graphical information (e.g., messages, fitness information, and the like) at a screen. Unlike traditional watches that use mechanical or physical hands to present the time of day, a computerized watch may also display, and periodically update, the time of day as a graphic at the screen. For example, a computerized watch may render an image of an analog watch face, including graphical representations of hour and minute hands, and output rendered image for display at a screen. The computerized watch may continuously update the image as the time of day changes.

Unfortunately, despite their ability to present more than just the time of day, some people prefer watches that present the time of day with actual mechanical or physical hands, in comparison to computerized watches that display the time of day as a rendered image of watch hands displayed on a screen. For instance, physical watch hands may be easier to see than graphical watch hands, particularly when viewing the watch face from an odd or shallow angle. In addition, even if a computerized watch utilizes a low-power mode or low-energy screen when displaying a graphical representation of the time of day, the computerized watch inevitably has to consume at least some electrical energy to power the screen, which may drain a battery.

DETAILED DESCRIPTION

In general, techniques of this disclosure may enable a computerized watch to use a set of physical watch hands to present the time of day in an air-gap region located between a cover of the computerized watch and a screen. For example, a computerized watch may include a screen for presenting graphical information (e.g., a graphical user interface). In addition, the computerized watch may include a cover (e.g., a transparent cover glass) layered above the screen to protects the screen from being soiled and/or damaged through normal use. Depending on whether the computerized watch is operating in a time display mode, the computerized watch may cause the physical hands to either present the time of day or not present the time of day. For example, the computerized watch may manipulate the physical watch hands such that the set of physical watch hands present the time of day between the cover and the screen by obscuring a portion of a display region of the screen. Alternatively, responsive to determining that the computerized watch is not operating in the time display mode, the computerized watch may manipulate the physical watch hands such that the set of physical hands do not obscure the screen.

In this way, when the computerized watch is operating in a time display mode, the example computerized watch may conserve electrical energy by powering-off its display and presenting the time of day using a set of physical watch hands that are located between the cover and the display. Since the physical watch hands are located between the cover and the screen (e.g., above the display) the physical watch hands may cast shadows onto the powered-off display, making it easier for a user to tell the time of day, regardless of the angle from which he or she views the watch face. In addition, by saving electrical energy through completely powering off the display, the example computerized watch may increase battery life and/or have the same battery life using a smaller battery as compared to other computerized watches. Using a smaller battery has the additional advantage of decreasing size, weight, and/or cost.

Figure 1A:
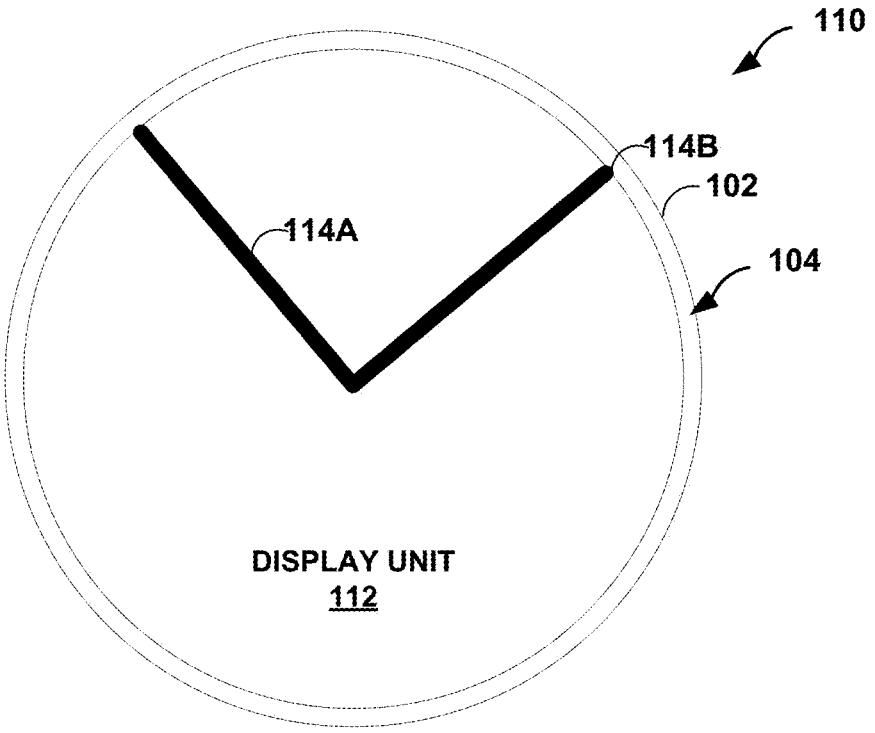
FIGS. 1A and 1B are conceptual diagrams illustrating top-down and cross-sectional side views of an example computerized watch that is configured to present the time using physical watch hands, in accordance with one or more aspects of the present disclosure.
Figure 1B:
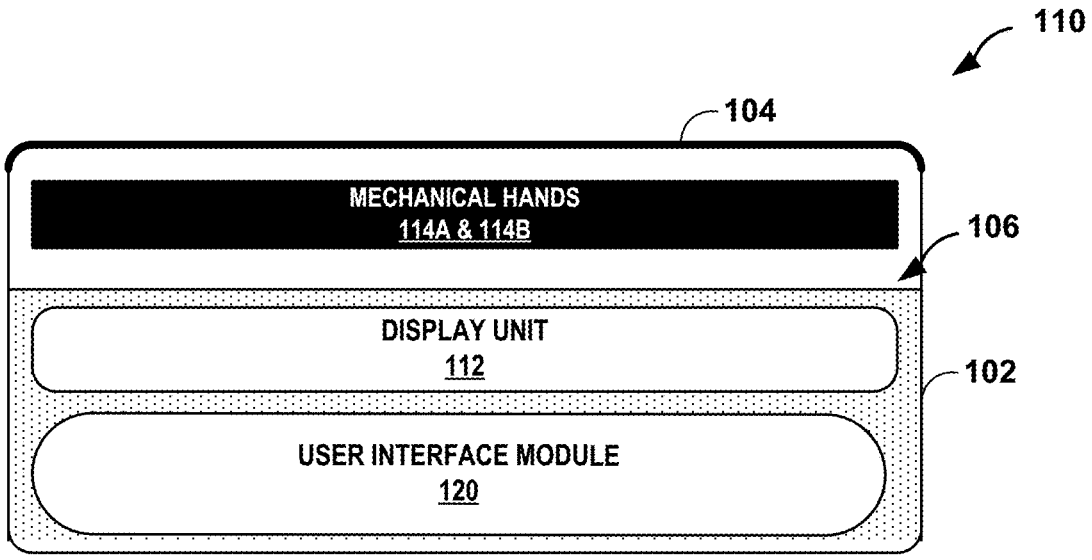

FIGS. 1A and 1B are conceptual diagrams illustrating top-down and cross-sectional side views of computing device 110 as an example computerized watch that is configured to present the time using physical watch hands, in accordance with one or more aspects of the present disclosure. FIG. 1A shows a top-down view of a watch face of computing device 110 and FIG. 1B shows a side/cross-sectional view of computing device 110. As seen from the top-down view of FIG. 1A, computing device 110 includes outer housing 102, transparent cover 104, display unit 112, and a set of physical watch hands 114 (also referred to herein as "mechanical watch hands"), which include watch hand 114A and watch hand 114B. As seen from the cross-sectional view of FIG. 1B, computing device 110 also includes user interface ("UI") module 122.

Although described primarily as being a computerized watch, computing device 110 may be, e.g., an "always-on" device or component of a system where it would be desirable for aesthetic and/or power saving reasons to present information in both physical and graphical form, even when computing device 110 is not likely being used. For example, computing device 110 may be a wristwatch, a fitness device, a clock or temperature gauge of a smart thermostat, smoke detector, carbon monoxide detector, security system, or other home or commercial building automation device, a gauge (e.g., speedometer) in a vehicle dashboard or cockpit, a gauge on a piece of equipment, or any and all other types of components of systems where it would be desirable for aesthetic and/or power saving reasons to present information in both physical and graphical form.

Display unit 112 is configured to output graphical information for display. Display unit 112 may include a pixel-array (also referred to herein as a "screen") for displaying information to a user. The screen of display unit 112 may be configured to output graphical information for display. For example, display unit 112 may present graphical elements and/or text that make up a graphical user interface of computing device 110.

Transparent cover 104 and outer housing 102 form the outer surfaces of computing device 110. The surface formed by transparent cover 104 is opposite the surface formed by outer housing 102. In other words, transparent cover 104 forms a top surface of computing device 110 through which a user can view the screen of display unit 112 and outer housing 102 forms a bottom surface of computing device 110 that when held in a user's palm or worn on a user's wrist, comes in contact with his or her skin.

Transparent cover 104 (referred to simply as "cover 104") may be a transparent or semitransparent piece of glass, plastic, or other suitable material that protects mechanical hands 114, display unit 112, UI module 120, and the other components of computing device 110 from being damaged due to moisture, debris, and/or forceful contact that computing device 110 may experience as a user wears computing device 110 on his or her wrist. Outer housing 102 represents the outer shell of computing device 110 that not only protects the components of computing device 110 from damage but also provides structural support. For example, outer housing 102 may be a casing made from metal, plastic, silicon, or some other suitable material to provide structure and rigidity to computing device 110.

Beneath transparent cover 104 is display unit 112. Display unit 112 of computing device 110 may, in some examples, be a presence-sensitive display. For example, display unit 112 may function as an input device (e.g., as a touchscreen) for computing device 110 and as an output device for computing device 110. Display unit 112 may be implemented using various technologies. For instance, display unit 112 may function as an input device using a presence-sensitive input component, such as a resistive touchscreen, a surface acoustic wave touchscreen, a capacitive touchscreen, a projective capacitance touchscreen, a pressure-sensitive screen, an acoustic pulse recognition touchscreen, or another presence-sensitive display technology. Display unit 112 may function as an output (e.g., display) device using any one or more display components, such as a liquid crystal display (LCD), dot matrix display, light emitting diode (LED) display, inorganic light-emitting diode (ILED), organic light-emitting diode (OLED) display, e-ink display, monochrome or color display, or any other type of emissive or transmissive display technology that is capable of outputting visible information to a user of computing device 110.

Between cover 104 and the screen or display surface of display unit 112 includes air-gap 106. Air-gap 106 represents a narrow region between a cover glass and a screen of other computerized watches that is typically devoid of any mechanical features. However, unlike other computing devices, computing device 110 includes a set of physical watch hands 114 within air-gap 106 that are configured to present the time between transparent cover 104 and the screen 112. Watch hand 114A may be an hour hand and watch hand 114B may be a second hand. Although shown as having two watch hands 114A and 114B, in some examples, computing device 110 may include a single or more than two watch hands 114.

In some examples, watch hands 114 may be formed from metallic material, composite material, silicon material, polymer material, or other suitable material for forming a set of physical watch hands that are configured to operate within air-gap 106, between transparent cover 104 and display unit 112. In some examples, watch hands 114 may be formed of spring steel. In some examples, watch hands 114 may be formed of a shape-memory alloy ("SMA"). SMA (also may be referred to as "smart metal," "memory metal," "memory alloy," "muscle wire," and "smart alloy") is an engineered material alloy that can change shape or color when exposed to various stimuli including but not limited to electrical, magnetic, light, and/or pressure.

UI module 120 of computing device 110 may control display unit 112 to cause display unit 112 to present or refrain from presenting graphical information, and may further control physical watch hands 114 to present or refrain from presenting the time. UI module 112 may be operable (e.g., by one or more processors of computing device 110) to process input received from a user (e.g., through a touch interface attached to display unit 112) and provide output for display at display unit 112.

As is described in further detail below, UI module 120 may also configure physical watch hands 114 and display unit 112 to operate in a certain way (e.g., in various modes depending on whether computing device 110 is to present or not present the time of day). That is, computing device 110 may operate in a time display mode in which computing device 110 is configured primarily for presenting the time of day or may operate in a graphical display mode in which computing device 110 is configured primarily for presenting graphical information at display unit 112.

UI module 120 may be implemented in hardware, software, firmware, or some combination thereof, residing in and/or executing at computing device 110. One or more processors of computing device 110 may implement functionality and/or execute instructions stored within computing device 110 for performing operations associated with UI module 120. Computing device 110 may execute UI module 120 with one processor or with multiple processors. In some examples, computing device 110 may execute UI module 120 as a virtual machine executing on underlying hardware. UI module 120 may execute as a service of an operating system or computing platform or may execute cloud based service accessible by computing device 110.

UI module 120 may act as an intermediary between various components of computing device 110 to make determinations based on input detected by a touch interface attached to display unit 112 and/or generate output presented by display unit 112. For instance, UI module 120 may receive, as an input from an application executing at computing device 110, a representation of elements of a graphical user interface. UI module 120 may also receive, as an input from the application, a sequence of touch events generated from information about user input detected by a touch interface attached to display unit 112 as the user interacts with the graphical user interface. UI module 120 may determine, based on the location components in the sequence touch events that one or more location components approximate a selection of one or more locations of the elements of the graphical user interface. UI module 120 may transmit, as output to the application, the sequence of touch events. UI module 120 may receive information from the application to update the graphical user interface presented by display unit 112, for example, to include text or other information based on the user interaction associated with the graphical user interface.

While some other computing devices tend to switch-off displays during periods of non-use, other so called "always-on" computing devices may display information, or at least maintain a display, or a portion thereof, in an actively ready-state for presenting information, even when the computing device is not being used. For example, a device may always display a clock or one or more other graphical indicators even after prolonged periods of user-inactivity and as a result, may waste power keeping portions of a display area activated even when the device is not being worn or not being used. Unlike these other always-on devices, UI module 120 may cause computing device 110 to power-off display unit 112 completely when computing device 110 is operating in a time display mode and therefore, not being used to present graphical information at the screen of display unit 112, and despite powering off display unit 112, computing device 110 may retain the ability to present the time of day.

For example, computing device 110 may operate in a time display mode when computing device 110 transitions from an active or powered on state in which computing device 110 presents graphical information at display unit 112 to a stand-by or inactive state in which computing device 110 is no longer presenting graphical information at display unit 112. In some examples, computing device 110 may transition to the time display mode automatically (e.g., after determining that a user has not provided input to the device for a period of time, in response to detecting a pattern of motion indicating the user is not viewing the display region of display unit 112, or after any other time that computing device 110 deems the user would likely prefer to view the time of day being presented at display unit 112).

In accordance with techniques of this disclosure, responsive to determining that computing device 110 is operating in a time display mode, UI module 120 may manipulate the set of physical watch hands 114 such that the set of physical watch hands 114 present the time of day by obscuring a portion of a display region of the screen of display unit 112. For example, UI module 120 may send a signal or command to a watch hand control component (e.g., a motor) of physical watch hands 114 that causes physical watch hands 114 to extend from a stowed position (e.g., a central position above the center of the display surface of display unit 112, a hidden position located at an edge or adjacent to the display surface of display unit 112, or from some other stowed position location as described herein) to an extended position. Once in the extended position, the watch hand control component may cause physical watch hands 114 to move and present the time of day.

Responsive to determining that computing device 110 is not operating in the time display mode, UI module 120 may manipulate the set of physical watch hands 114 such that the set of physical hands 114 do not obscure the screen. For example, UI module 120 may send a signal or command to the watch hand control component of physical watch hands 114 that causes physical watch hands 114 to retract from the extended position to the stowed position. Once in the stowed position, the watch hand control component may cease causing physical watch hands 114 to move and present the time of day.

In this way, when an example computing device, such as computing device 110 is operating in a time display mode, the example computing device may conserve electrical energy by powering-off its display and presenting the time of day using a set of physical watch hands that are located between the cover glass and the display. Since the physical watch hands are located between the cover and the screen (e.g., above the display), the physical watch hands may cast shadows onto the powered-off display, making it easier for a user to tell the time of day, no matter from which angle that he or she views the watch face. In addition, by saving electrical energy through completely powering off the display, the example computing device may have an increased battery life and/or have the same battery life using a smaller battery as compared to other computerized watches. Using a smaller battery has the additional advantage of decreasing size (e.g., volume), weight, and/or cost.

Figure 2:
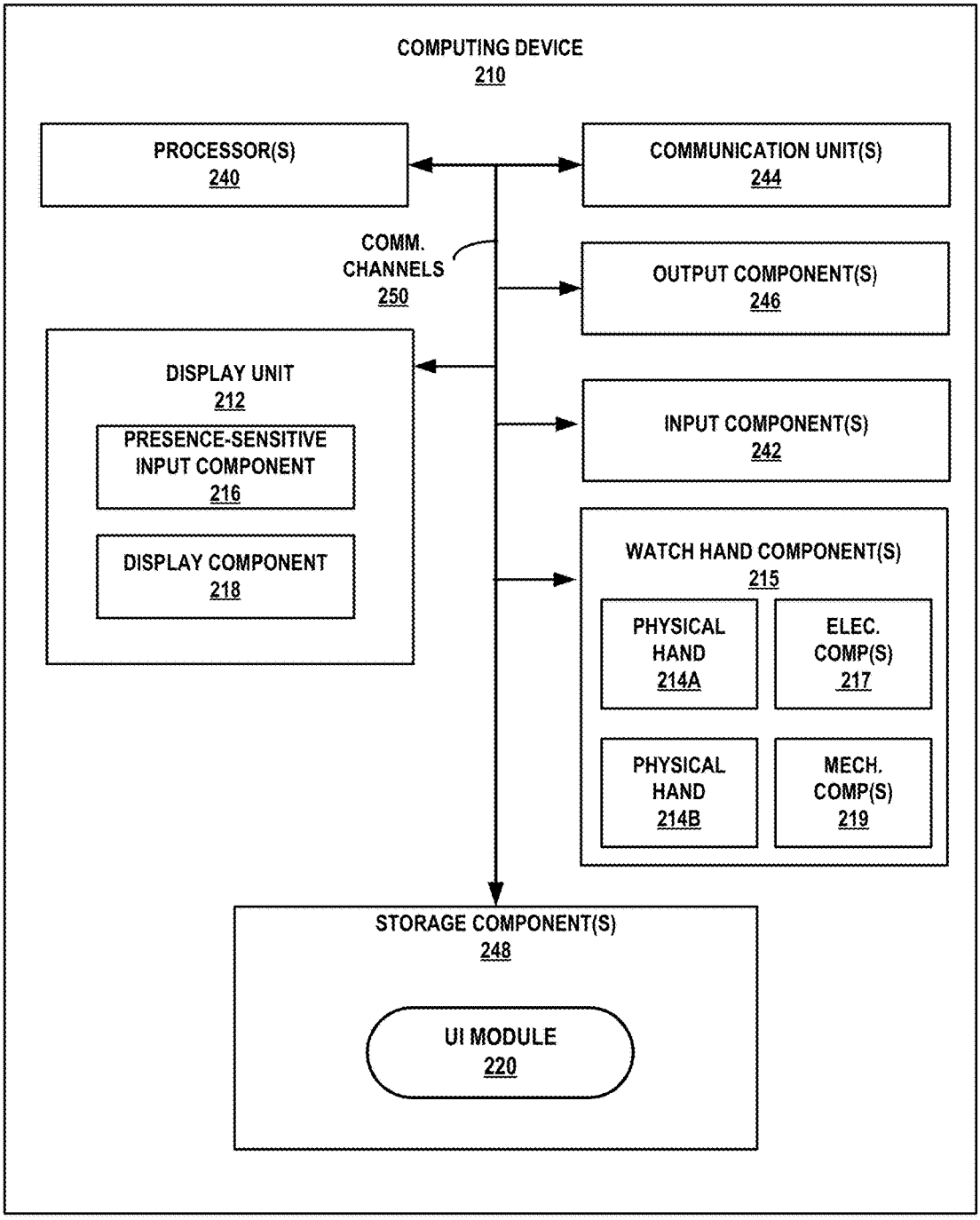
FIG. 2 is a block diagram illustrating an example computerized watch that is configured to present the time using physical watch hands, in accordance with one or more aspects of the present disclosure.

FIG. 2 is a block diagram illustrating computing device 210 as an example computerized watch that is configured to present the time using physical watch hands, in accordance with one or more aspects of the present disclosure. Computing device 210 represents a more detailed example of computing device 110 of FIG. 1 and is described below in the context of computing device 110 of FIG. 1. For example, display unit 212 is analogous to display unit 112 of FIG. 1, UI module 220 is analogous to UI module 120 of FIG. 1, etc.

Computing device 210 includes one or more processors 240, one or more communication unit 244, one or more output components 264, one or more input components 242, display unit 212, one or more watch hand components 215, and one or more storage components 248. Storage components 248 include UI module 220, and display unit 212 includes presence-sensitive input component 216 and display component 218. Watch hand components 215 include physical hands 214A and 24B, electrical components 217, and mechanical components 219. Each of components 240, 242, 244, 246, 212, 216, 218, 215, 214A, 214B, 217, and 219 is communicatively coupled via one or more communication channels 250. In other words, communication channels 250 may interconnect each of the various components of computing device 210 for inter-component communications (physically, communicatively, and/or operatively). In some examples, communication channels 250 may include a system bus, a network connection, an inter-process communication data structure, or any other method for communicating data.

One or more input components 242 of computing device 210 may receive input. Examples of input are tactile, audio, and video input. Input components 242 of computing device 210, in one example, includes a presence-sensitive display, touch-sensitive screen, mouse, keyboard, voice responsive system, video camera, microphone or any other type of device for detecting input from a human or machine. One or more input components 242 may further include one or more sensor components. Numerous examples of sensor components exist and include any input component configured to obtain environmental information about the circumstances surrounding computing device 210, such as one or more location sensors (GPS components, Wi-Fi components, cellular components), one or more temperature sensors, one or more movement sensors (e.g., accelerometers, gyros), one or more pressure sensors (e.g., barometer), one or more ambient light sensors, and one or more other sensors (e.g., microphone, camera, infrared proximity sensor, hygrometer, and the like).

One or more output components 246 of computing device 210 may generate output. Examples of output are tactile, audio, and video output. Output components 246 of computing device 210, in one example, includes a presence-sensitive display, sound card, video graphics adapter card, speaker, cathode ray tube (CRT) monitor, LCD, ILED, OLED, or any other type of device for generating output to a human or machine.

One or more communication units 244 of computing device 210 may communicate with external devices via one or more wired and/or wireless networks by transmitting and/or receiving network signals on the one or more networks. Examples of communication units 244 include a network interface card (e.g. such as an Ethernet card), an optical transceiver, a radio frequency transceiver, a GPS receiver, or any other type of device that can send and/or receive information. Other examples of communication units 244 may include short wave radios, cellular data radios, wireless network radios, NFC, as well as universal serial bus (USB) controllers.

One or more processors 240 may implement functionality and/or execute instructions within computing device 210. For example, processors 240 on computing device 210 may receive and execute instructions stored by storage components 248 that execute the functionality of module 220. The instructions executed by processors 240 may cause computing device 210 to store information within storage components 248 during program execution. Examples of processors 240 include application processors, display controllers, sensor hubs, and any other hardware configure to function as a processing unit. Processors 240 may execute instructions of module 220 to cause display unit 212 to configure display component 218 to output or refrain from outputting graphical information for display. That is, module 220 may be operable by processors 240 to perform various actions or functions of computing device 210 described herein.

One or more storage components 248 within computing device 210 may store information for processing during operation of computing device 210 (e.g., computing device 210 may store data accessed by module 220 during execution at computing device 210). In some examples, storage components 248 may comprise a temporary memory, meaning that a primary purpose of storage component 248 is not long-term storage. Storage components 248 on computing device 210 may be configured for short-term storage of information as volatile memory and therefore not retain stored contents if powered off. Examples of volatile memories include random access memories (RAM), dynamic random access memories (DRAM), static random access memories (SRAM), and other forms of volatile memories known in the art.

Storage components 248, in some examples, also include one or more computer-readable storage media. Storage components 248 may be configured to store larger amounts of information than volatile memory. Storage components 248 may further be configured for long-term storage of information as non-volatile memory space and retain information after power on/off cycles. Examples of non-volatile memories include magnetic hard discs, optical discs, floppy discs, flash memories, or forms of electrically programmable memories (EPROM) or electrically erasable and programmable (EEPROM) memories. Storage components 248 may store program instructions and/or information (e.g., data) associated with module 220.

Display unit 212 of computing device 210 includes display component 218 and presence-sensitive input component 216. Display component 218 may be a screen at which information is displayed by display unit 212 and presence-sensitive input component 216 may detect an object at and/or near display component 218. As one example range, presence-sensitive input component 216 may detect an object, such as a finger or stylus that is within two inches or less of display component 218. Presence-sensitive input component 216 may determine a location (e.g., an [x, y] coordinate) of display component 218 at which the object was detected. In another example range, presence-sensitive input component 216 may detect an object six inches or less from display component 218 and other ranges are also possible. Presence-sensitive input component 216 may determine the location of display component 218 selected by a user's finger using capacitive, inductive, and/or optical recognition techniques. In some examples, presence-sensitive input component 216 also provides output to a user using tactile, audio, or video stimuli as described with respect to display component 218. In the example of FIG. 2, display unit 212 may present a user interface (such as a graphical user interface for receiving touch or voice input and outputting graphical information in response thereto).

Display unit 212 of computing device 210 may receive tactile input from a user of computing device 210. Display unit 212 may receive indications of the tactile input by detecting one or more tap or non-tap gestures from a user of computing device 210 (e.g., the user touching or pointing to one or more locations of display unit 212 with a finger or a stylus pen). Display unit 212 may present output to a user. Display unit 212 may present the output as a graphical user interface, which may be associated with functionality provided by various features of or applications executing at computing device 210. For example, display unit 212 may present various user interfaces of components of a computing platform, operating system, applications, or services executing at or accessible by computing device 210 (e.g., an electronic message application, a navigation application, an Internet browser application, a mobile operating system, etc.). A user may interact with a respective user interface to cause computing device 210 to perform operations relating to one or more the various functions. For example, UI module 220 may cause display unit 212 to present a graphical user interface associated with a text input function of computing device 210, a search function of computing device 210, a predictive reminder function of computing device 210, a voice-to-speech function of computing device 210, a fitness tracker function of computing device 210, or any other function of computing device 210. The user of computing device 210 may view output presented as feedback associated with the various functions of computing device 210 and provide input to display unit 212 to compose interact and engage with said functions.

Display unit 212 of computing device 210 may detect two-dimensional and/or three-dimensional gestures as input from a user of computing device 210. For instance, a sensor of display unit 212 may detect a user's movement (e.g., moving a hand, an arm, a pen, a stylus, etc.) within a threshold distance of the sensor of display unit 212. Display unit 212 may determine a two or three dimensional vector representation of the movement and correlate the vector representation to a gesture input (e.g., a hand-wave, a pinch, a clap, a pen stroke, etc.) that has multiple dimensions. In other words, display unit 212 can detect a multi-dimension gesture without requiring the user to gesture at or near a screen or surface at which display unit 212 outputs information for display. Instead, display unit 212 can detect a multi-dimensional gesture performed at or near a sensor which may or may not be located near the screen or surface at which display unit 212 outputs information for display.

Watch hand components 215 represent the mechanical and/or electrical components of computing device 210 that are configured to present a time of day between a transparent cover of computing device 210 (not shown) and display component 218 (e.g., a screen). In some examples, watch hand components 215 include a hub or housing for containing each of the components of watch hand components 215.

Physical hands 214A and 214B are analogous to physical watch hands 114A and 114B from FIG. 1. In some examples, watch hand components 215 may include more than two physical watch hands (e.g., a third physical watch hand for displaying seconds in addition to displaying hours an minutes with the other two physical watch hands). In some examples, watch hand component 215 may include a single physical watch hand (e.g., for presenting elapsed seconds, for instance, as a stopwatch or timer).

Electric components 217 and mechanical components 219 represent any and all electrical and mechanical components necessary for manipulating and for controlling movement of physical hands 214 to present the time of day. For example, electric components 217 may include piezo-electric components, solenoidal components, motors, resistors, conductors, capacitors, microcontrollers, processors, or any other electrical hardware for manipulating and for controlling movement of physical hands 214 to present the time of day. Mechanical components 219 may include one or more mechanical gears, rods, pistons, quartz crystals, or any other mechanical component necessary for manipulating and for controlling movement of physical hands 214 to present the time of day.

Mechanical components 219 alone or in combination with electric components 217 may be configured to control movement of physical hands 214 as a manual movement, automatic movement, or quartz movement. For example, when configured as a mechanical movement, mechanical components 219 may include a crown, mainspring, gear train, escapement, balance wheel, dial train, and one or more jewels. When configured as an automatic movement, mechanical components 219 may include a crown, mainspring, gear train, escapement, balance wheel, dial train, one or more jewels, and a rotor. And when configured as an automatic movement, mechanical components 219 may include a quartz crystal and a dial train, and may rely on a battery, controlling integrated circuit, and a motor (e.g., a stepping motor) of electric components 217.

In some examples, physical hands 214 may be formed from a highly flexible spring steel that enables physical hands to return to their original shape despite significant deflection or twisting. When formed of spring steel, mechanical components 219 may include a piston and electrical components 217 may include a piston control component that applies a stimulus to the piston to extend and push watch hands 214 from a stowed position to an extended position and applies a stimulus to the piston to retract and pull watch hands 214 from the extended position to the stowed position.

In some examples, physical hands 214 may be formed from may be formed of SMA. When formed of SMA, electric components 217 may include a SMA control component that applies a stimulus (e.g., applied temperature, electro-magnetic field, pressure, etc.) to cause watch hands 214 to change from being in a first shape (e.g., a stowed position) to being in a second shape (e.g., an extended position), or vice versa.

In operation, responsive to determining that computing device 210 is operating in a time display mode, UI module 220 may send a signal or command via communication channels 250 that causes electrical components 217 and/or mechanical components 219 of watch hand components 215 to manipulate physical watch hands 214A and 214B such that physical watch hands 214A and 214B present the time of day by obscuring a portion of a display region of display component 218 of display unit 212. For example, UI module 220 may detect, based on information obtained from a sensor of input components 242, a pattern of movement associated with computing device 210. Based on the pattern of movement, UI module 220 may determine a user of computing device 210 is no longer holding computing device 210 in a way that suggests he or she is likely viewing graphical information presented by display component 218.

UI module 220 may cause computing device 210 to operate in a time display mode in which UI module 220 may cause display unit 212 to power-off or otherwise cease presenting graphical information using display component 218 and may cause watch hand components 215 to manipulate physical hands 214 such that they change from being in a stowed position to an un-stowed position for presenting the time of day. For example, UI module 220 may cause physical hands to extend from a retracted position to an extended position out over a portion of the display region of display component 218 to present the time of day. In some examples, UI module 220 may cause physical hands to twist from a concealed position in which a very thin (e.g., less than one millimeter) and substantially planar surface of physical hands 214 is perpendicular to the display region of display component 218 to an un-concealed position in which the substantially planar surface of physical hands 214 is parallel, and partially obscures, the display region of display component 218.

Responsive to determining that computing device 210 is not operating in the time display mode, UI module 220 may manipulate physical hands 214 such that the physical hands 214 do not obscure display component 218. For example, UI module 220 may detect, based on information obtained from a sensor of input components 242, a pattern of movement associated with computing device 210. Based on the pattern of movement, UI module 220 may determine a user of computing device 210 is holding computing device 210 in way that suggests he or she is likely viewing graphical information presented by display component 218.

UI module 220 may cause computing device 210 to cease operating in the time display mode in which UI module 220 may cause display unit 212 to power-on or otherwise resume presenting graphical information using display component 218 and may cause watch hand components 215 to manipulate physical hands 214 such that they change from being in an un-stowed or extended position to a stowed or retracted position where physical hands 214 no longer obscure display component 218. For example, UI module 220 may cause physical hands to retract from the extended position to the retracted position in the center of the display region of display component 218 or adjacent to the display region of display component 218. In some examples, UI module 220 may cause physical hands to twist from an unconcealed position in which a substantially planar surface of physical hands 214 is parallel to the display region of display component 218 to a concealed position in which the substantially planar surface of physical hands 214 is perpendicular, and due to the very small thickness of physical hands 214, does not visibly obscure, the display region of display component 218.

FIGS. 3A-3H are conceptual diagrams illustrating top-down and cross-sectional side views of computing device 310 as an additional example computerized watch that is configured to present the time using physical watch hands, in accordance with one or more aspects of the present disclosure. Computing device 310 represents one example of computing device 110 of FIG. 1 and is described below in the context of computing device 110 of FIG. 1. For example, display unit 312 of FIGS. 3A-3H is analogous to display unit 112 of FIG. 1, UI module 320 is analogous to UI module 120 of FIG. 1, etc.

Figure 3A:
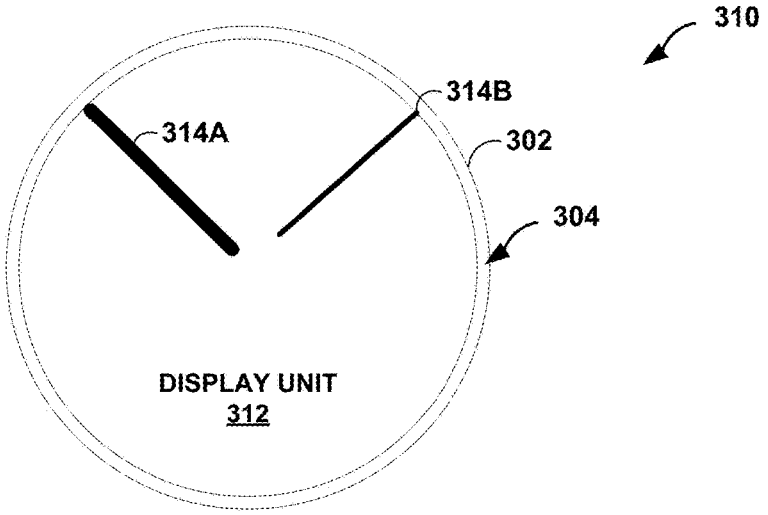
FIGS. 3A-3H are conceptual diagrams illustrating top-down and cross-sectional side views of an additional example computerized watch that is configured to present the time using physical watch hands, in accordance with one or more aspects of the present disclosure.
Figure 3B:
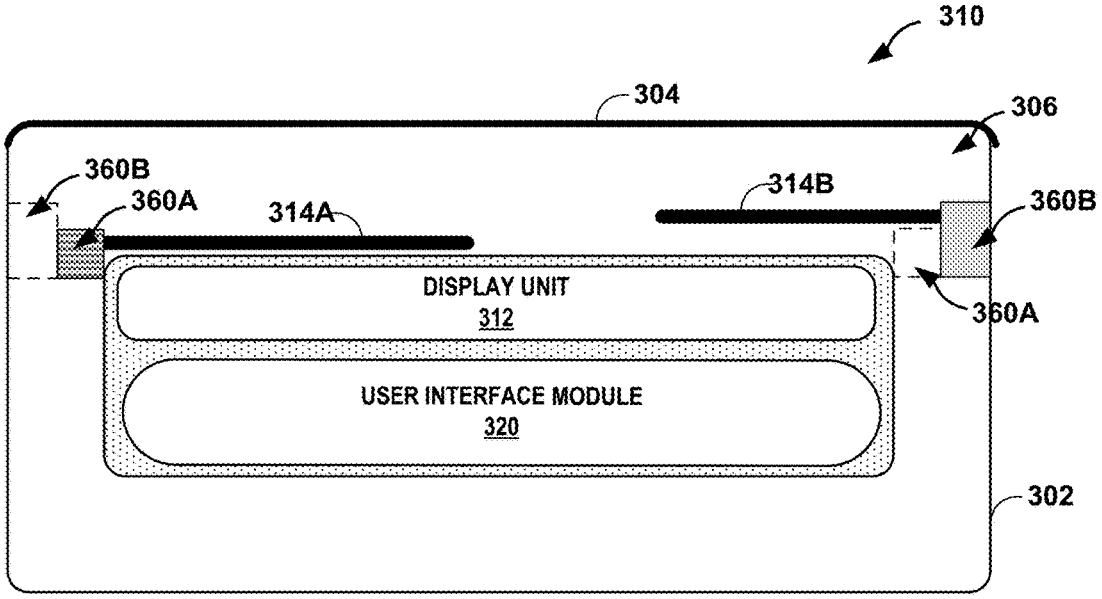
Figure 3C:
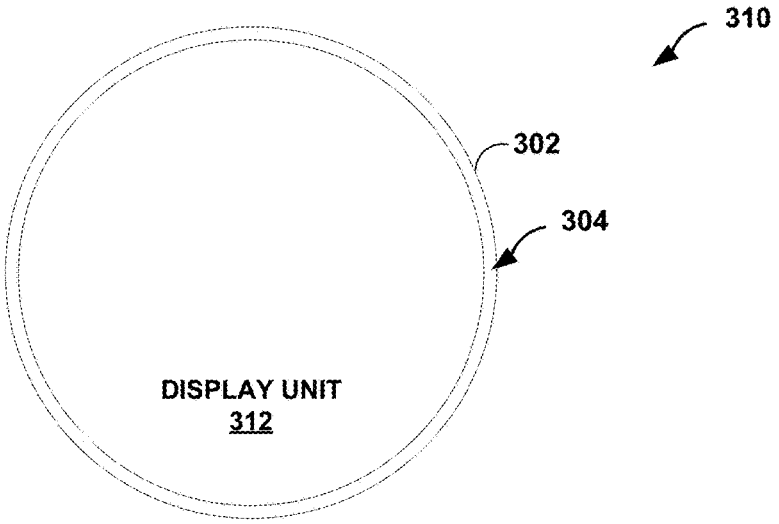

Computing device 310 includes physical hands 314, transparent cover 304, outer housing 302, display unit 312, UI module 320, and hubs 360A and 360B. Physical hands 314 are configured to extend from a stowed position to an extended position to present the time of day between transparent cover 304 and the screen of UID 312. UI module 320 may manipulate the set of watch physical hands 314 by extending physical hands from the stowed position to the extended position in response to determining that computing device 310 is operating in the time display mode and UI module 320 may manipulate physical hands 314 by retracting physical hands 314 from the extended position to the stowed position in response to determining that computing device 310 is not operating in the time display mode. FIGS. 3A and 3B illustrate the extended position of physical hands 314 and FIGS. 3C and 3D show physical hands 314 in a stowed position.

Figure 3D:
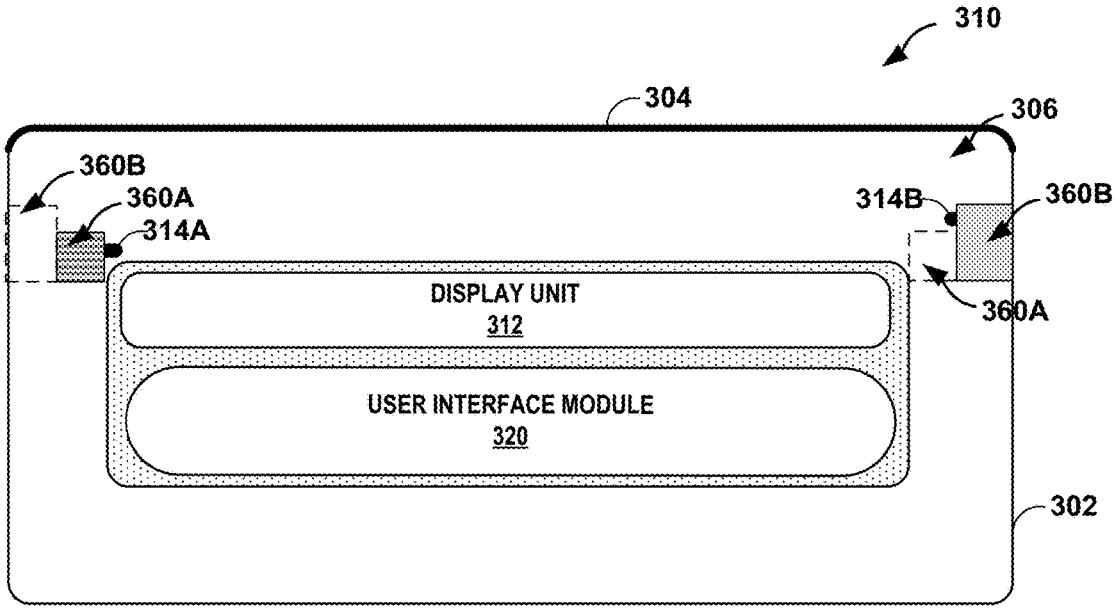

For example, as shown in FIGS. 3B and 3D, transparent cover 304 forms a first outer surface of computing device 310 and outer housing 302 forms a second surface of computing device 310 that is opposite the first surface. The stowed position of physical hands 314 is located outside or adjacent to an outer edge of the screen of UID 312 between the screen of UID 312 and outer housing 302. For instance, hands 314 may flatten against the internal side walls of housing 302. In some examples, as shown in FIGS. 3B and 3D, computing device 310 includes hubs 360A and 360B located between the screen of display unit 312 and outer housing 302 that contains physical hands 314 when retracted to the stowed position.

In some examples, physical hands 314 are configured to extend from the stowed position to the extended position by stretching from outside the outer edge of the display region of the screen of display unit 312 to the extended position above the display region of the screen of display unit 312, and physical hands 314 are configured to retract from the un-stowed position to the stowed position by shrinking from above the display region of the screen of display unit 312 to the stowed position outside the outer edge of the display region of the screen of display unit 312. For example, when UI module 320 causes physical hands 314 to be in the stowed position, UI module 320 may retract physical hands 314 from the extended position shown in FIGS. 3A and 3B to the retracted position shown in FIGS. 3C and 3D. Conversely, when UI module 320 causes physical hands 314 to be in the un-stowed position, UI module 320 may extend physical hands 314 from the stowed position shown in FIGS. 3C and 3D to the extended position shown in FIGS. 3A and 3B.

Hubs 360A and 360B may include respective control components for extending and retracting hands 314 to and from the extended and stowed positions. Hubs 360A and 360B may rotate around the circumference of the display region of display unit 312 with increments in time. The outlines show how depending on the time being displayed, the cross sectional view of hubs 360A and 360B may appear to the left or right of the screen.

Watch hands 314 may be made from SMA and hubs 360A and 360B may include electrical and mechanical components for stretching and shrinking hands 314 to and from the extended position. In other examples, watch hands 314 may be made from some other metallic, plastic, or silicon material and hubs 360A and 360B may include a piston and other electrical and mechanical components for pushing and pulling hands 314 to and from the extended position.

Figure 3E:
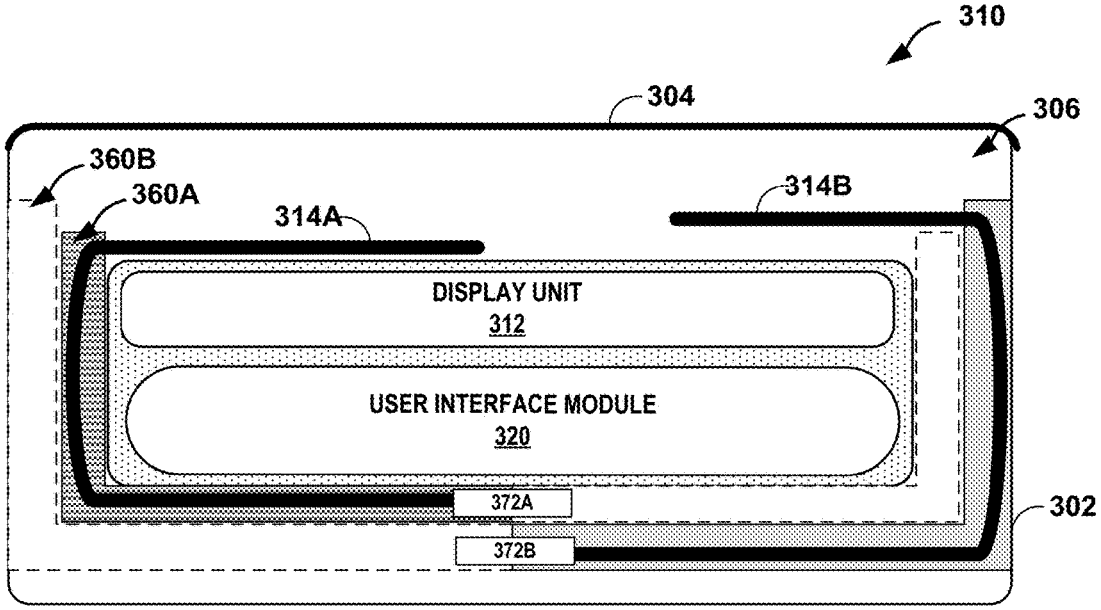
Figure 3F:
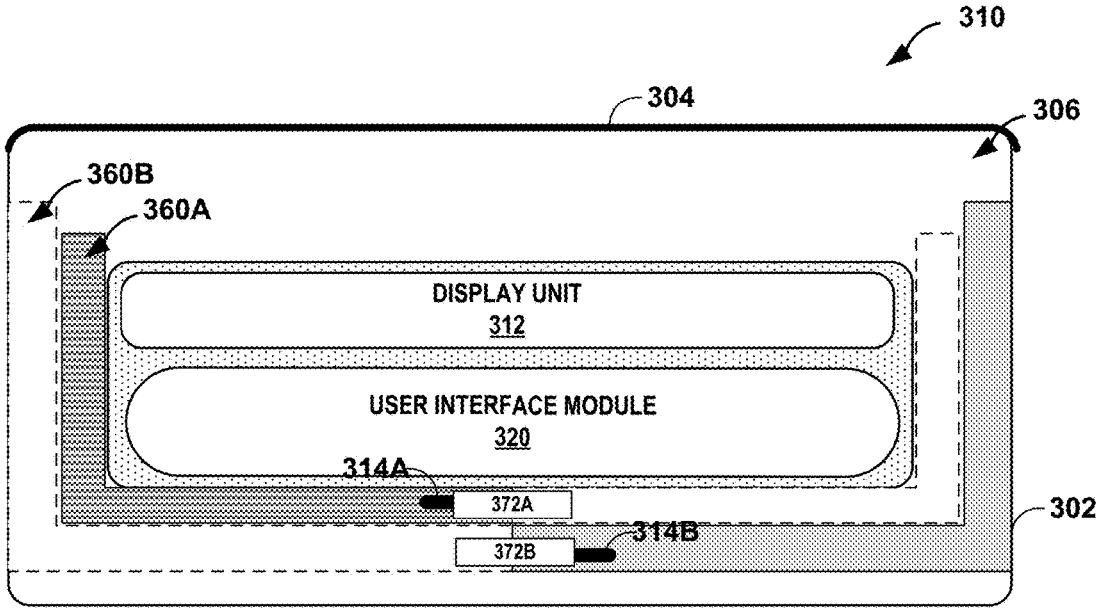

FIGS. 3E and 3F show an example of computing device 310 in which hub 360A wraps around the outer edge of the display surface of display unit 312 and includes piston 372A and hub 360B wraps around the outer edge of the display surface of display unit 312 and includes piston 372B. In the example of FIGS. 3E and 3F, hands 314 may be made from spring steel or some other flexible material that bends easily and returns to its original shape. UI module 320 may control pistons 372A and 372B to extend hands 314 from beneath display unit 312 and above the display region of display unit 312 when computing device operates in a time display mode. UI module 320 may control pistons 372A and 372B to retract hands 314 from above display unit 312 and beneath the display region of display unit 312 when computing device 310 is not operating in the time display mode.

Figure 3G:
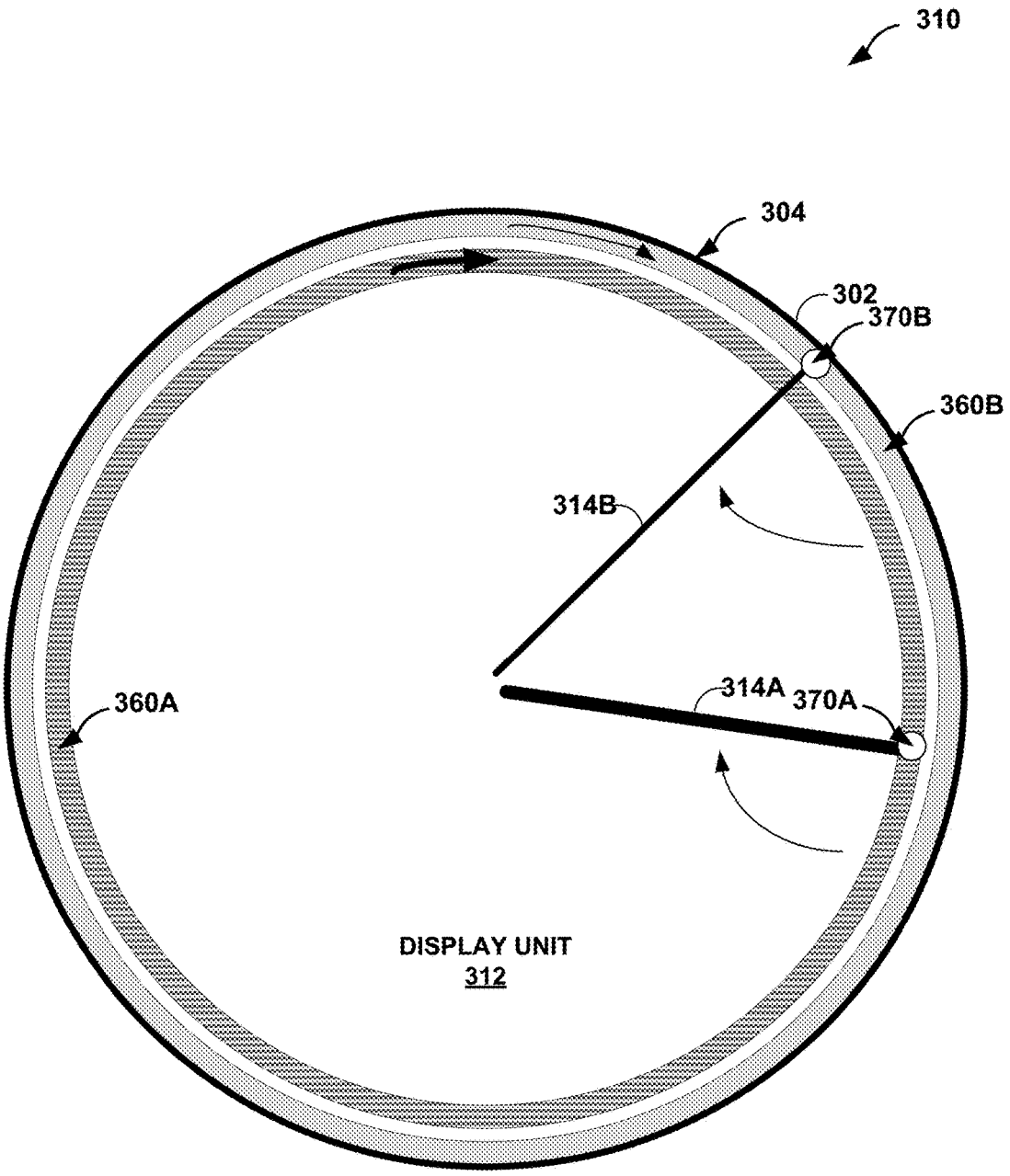
Figure 3H:
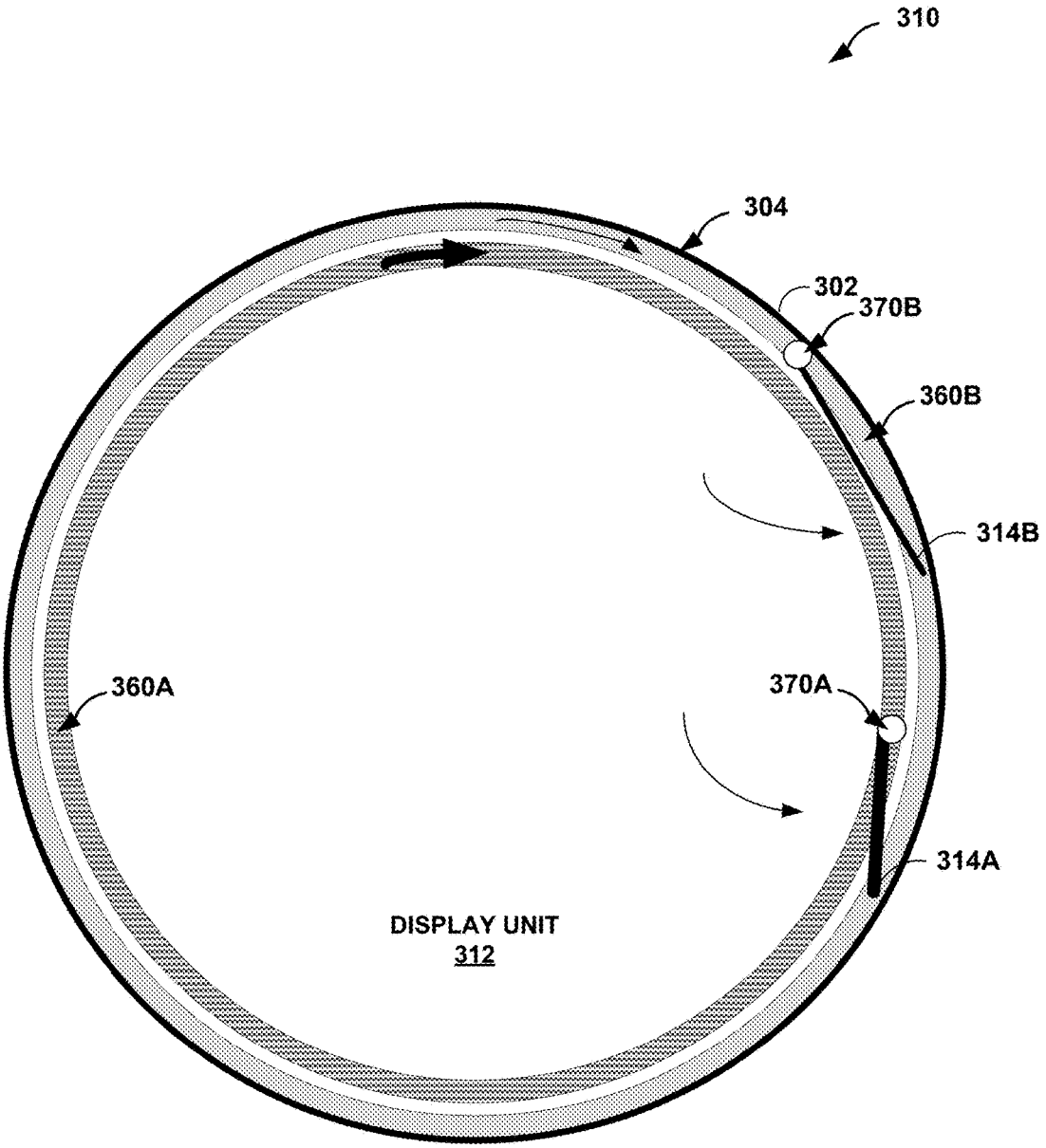

FIGS. 3G and 3H show a top-down view of an additional example of computing device 310. Hubs 360A and 360B are shown as being rotating wheels or gears that each includes a respective pivot component 370A and 370B that is coupled to a respective physical hand 314A or 314B. For example, hub 360A may be a main or outer gear associated with pivot component 372A which acts as an inner or sub gear that is coupled to hand 314A. Hub 360B may be a main or outer gear associated with pivot component 372B which acts as an inner or sub gear that is coupled to hand 314B.

UI module 320 may cause the position of pivot component 370A to rotate clockwise with the change in minute time of day and UI module 320 may cause the position of pivot component to rotate clockwise with the change in hour time of day, or vice versa. UI module 320 may control pivot components 370A and 370B to extend hands 314 out above display unit 312, as shown in FIG. 3G when computing device 310 is operating in a time display mode. UI module 320 may control pivot components 370A and 370B to retract hands 314 from above display unit 312, as shown in FIG. 3H when computing device 310 is not operating in the time display mode. In some examples, in addition to rotating hands 314 to change their position, UI module 320 may further cause hands to retract in length so as to better stow adjacent to the inner wall of housing 302.

FIGS. 4A-4D are conceptual diagrams illustrating top-down and cross-sectional side views of computing device 410 as an additional example computerized watch that is configured to present the time using physical watch hands, in accordance with one or more aspects of the present disclosure. Computing device 410 represents one example of computing device 110 of FIG. 1 and is described below in the context of computing device 110 of FIG. 1. For example, display unit 412 of FIGS. 4A-4D is analogous to display unit 112 of FIG. 1, UI module 420 is analogous to UI module 120 of FIG. 1, etc.

Figure 4A:
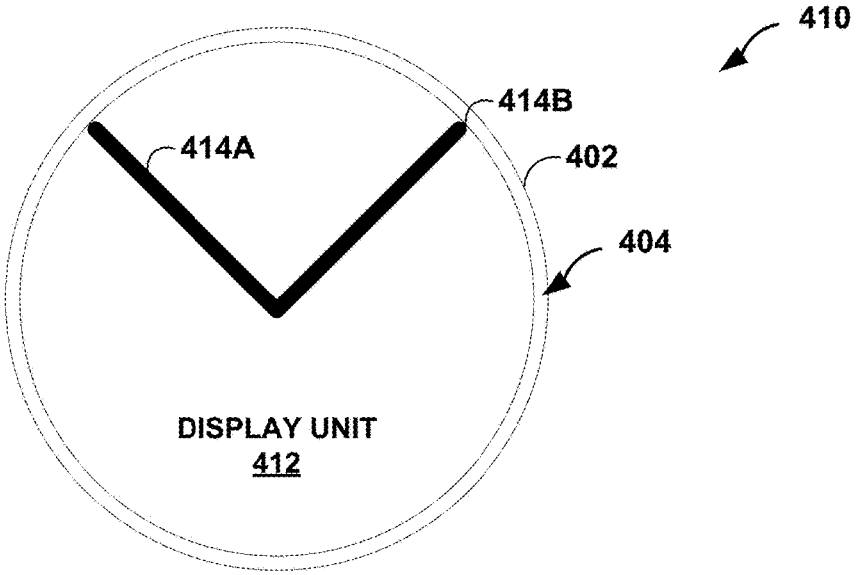
FIGS. 4A-4D are conceptual diagrams illustrating top-down and cross-sectional side views of an additional example computerized watch that is configured to present the time using physical watch hands, in accordance with one or more aspects of the present disclosure.
Figure 4B:
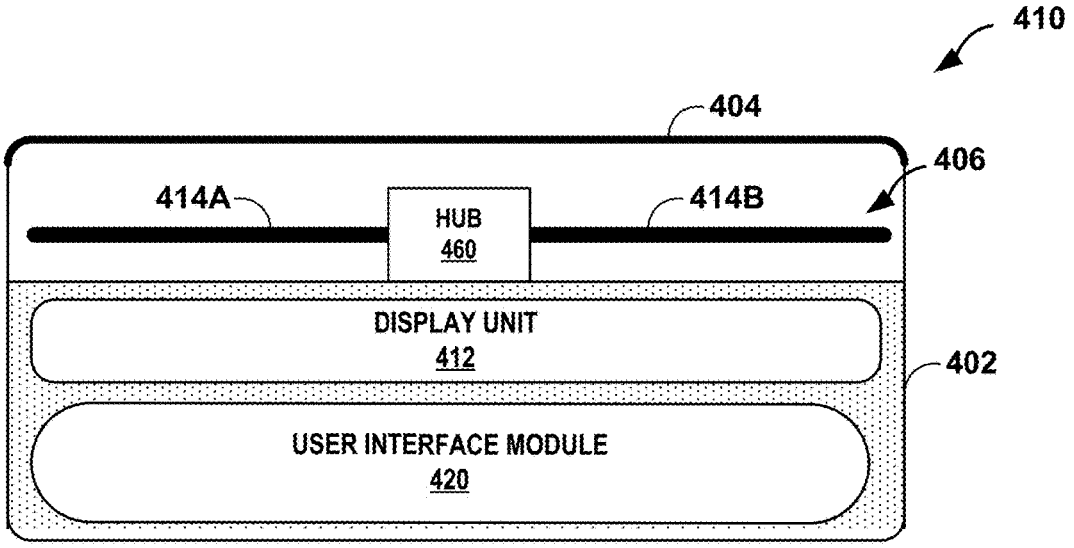
Figure 4C:
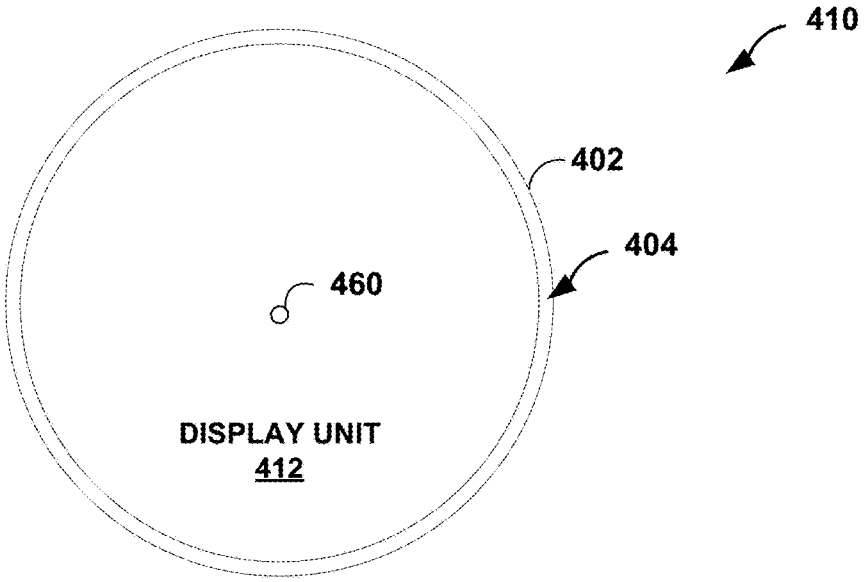
Figure 4D:
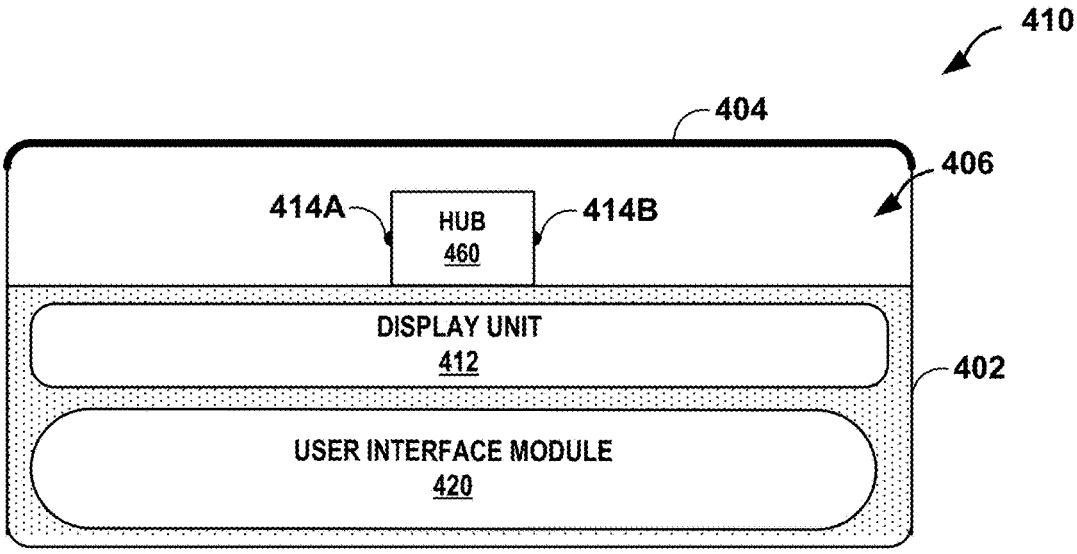

Computing device 410 includes physical hands 414, transparent cover 404, outer housing 402, display unit 412, UI module 420, and hub 460. Physical hands 414 are configured to extend from a stowed position to an extended position to present the time of day between transparent cover 404 and the screen of UID 412. UI module 420 may manipulate the set of watch physical hands 414 by extending physical hands from the stowed position to the extended position in response to determining that computing device 410 is operating in the time display mode and UI module 420 may manipulate physical hands 414 by retracting physical hands 414 from the extended position to the stowed position in response to determining that computing device 410 is not operating in the time display mode. FIGS. 4A and 4B illustrate the extended position of physical hands 414 and FIGS. 4C and 4D show physical hands 414 in a stowed position. Similar to hubs 360A and 360B, hub 460 may include respective control components for extending and retracting hands 414 to and from the extended and stowed positions.

For example, as shown in FIGS. 4C and 4D, the stowed position of physical hands 414 corresponds to a central location of the display region of the screen of UID 412 that is between transparent cover 404 and the screen of UID 412. In some examples, also shown in FIGS. 4C and 4D, computing device 410 may include hub 460 located between transparent cover 404 and the screen of UID 412 such that when physical hands 414 are in the stowed position, physical hands 414 are contained within hub 460.

In some examples, physical hands 414 are configured to extend from the stowed position to the extended position by extending from the center of the display region of the screen of display unit 414 to the extended position and physical hands 414 are configured to retract from the un-stowed or extended position to the stowed or un-extended position by retracting back into the center of the display region of the screen of display unit 414. For example, when UI module 420 causes physical hands 414 to be in the stowed position, UI module 420 may retract physical hands 414 from the extended position shown in FIGS. 4A and 4B to the retracted position shown in FIGS. 4C and 4D. Conversely, when UI module 420 causes physical hands 414 to be in the un-stowed position, UI module 420 may extend physical hands 314 from the stowed position shown in FIGS. 4C and 4D to the extended position shown in FIGS. 4A and 4B.

Figure 5A:
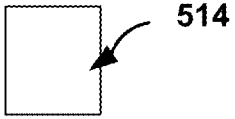
FIGS. 5A and 5B are conceptual diagrams illustrating extended and stowed positions of example physical watch hands, in accordance with one or more aspects of the present disclosure.
Figure 5B:
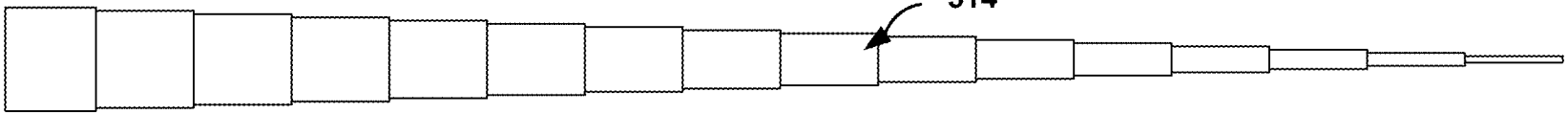

FIGS. 5A and 5B are conceptual diagrams illustrating physical hand 514 as an example physical watch hand that is in an extended and stowed position, in accordance with one or more aspects of the present disclosure. FIGS. 5A and 5B are described in the context of FIGS. 1, 2, 3A-3D, and 4A-4D. For example, physical hand 514 is analogous to physical hand 114A or physical hand 114B of FIG. 1.

FIG. 5A shows physical hand 514 in a stowed or retracted position and FIG. 5B shows physical hand 514 in an extended or un-stowed position. For example, physical 514 may be made up of several interconnected portions of metallic or polymer material that are configured to collapse or fold into a retracted position (as shown in FIG. 5A) and extend or unfold into an extended position (as shown in FIG. 5B). In some examples, physical hand 514 may be made from SMA and when the temperature of physical hand 514 is above an activation temperature of the SMA, physical hand may be in the retracted position of FIG. 5A and when below the activation temperature, physical hand may be in the extended position as shown in FIG. 5B.

Figure 6A:
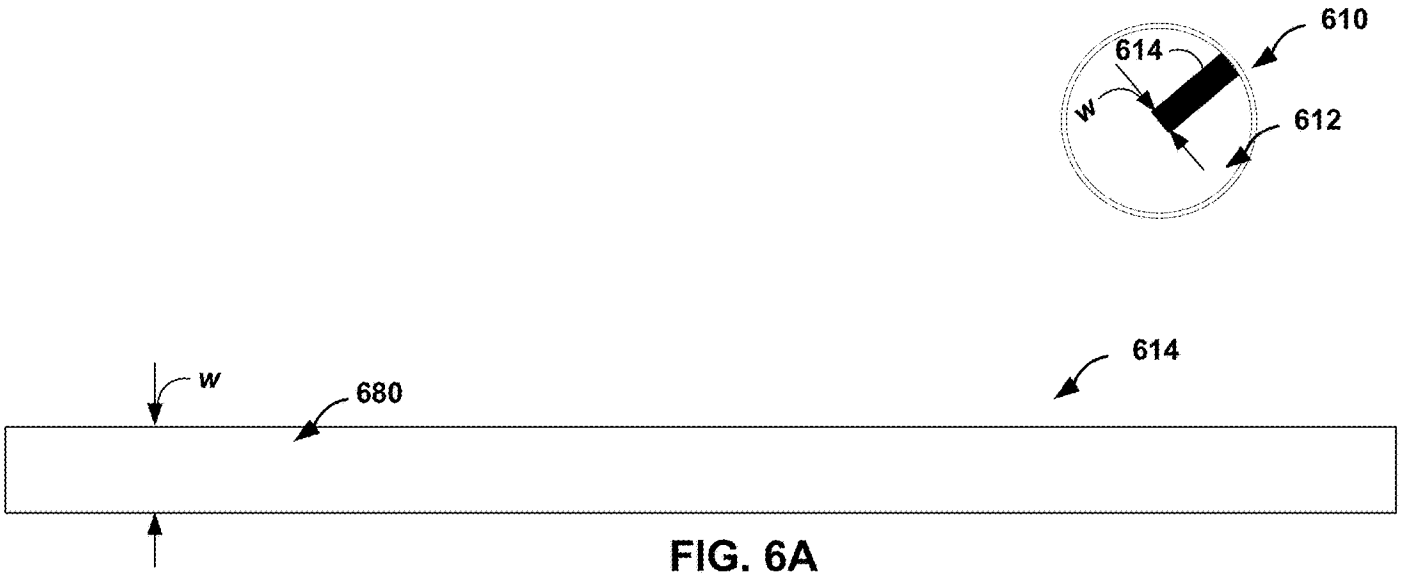
FIGS. 6A and 6B are conceptual diagrams illustrating visible and hidden positions of additional example physical watch hands, in accordance with one or more aspects of the present disclosure.
Figure 6B:
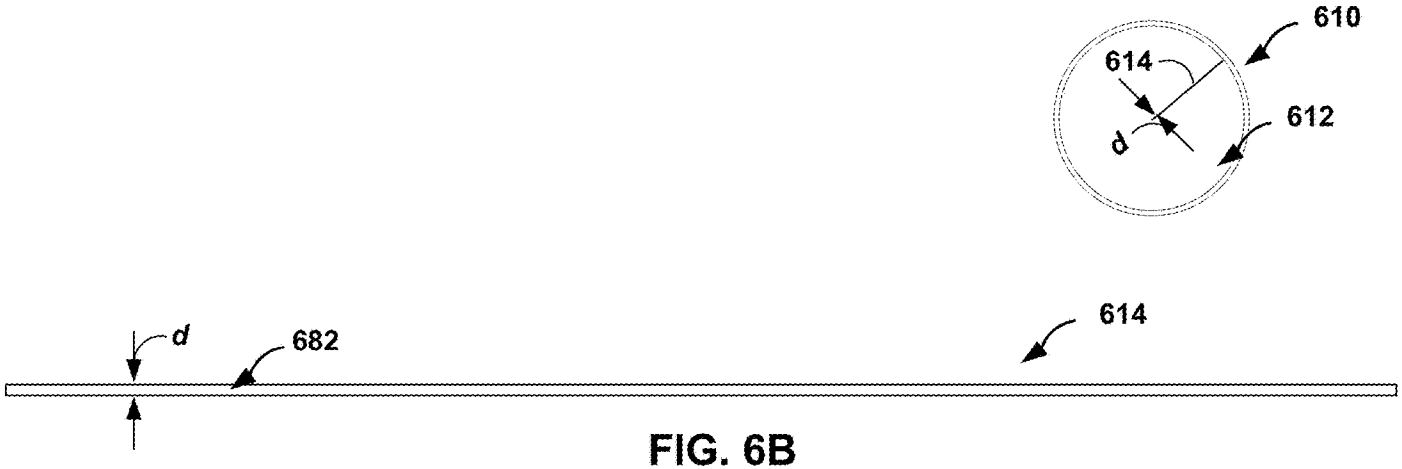

FIGS. 6A and 6B are conceptual diagrams illustrating visible and hidden positions of physical hand 614 as an additional example a physical watch hand, in accordance with one or more aspects of the present disclosure. FIGS. 6A and 6B are described in the context of FIGS. 1, 2, 3A-3D, and 4A-4D. For example, computing device 610 and display unit 612 are analogous to computing device 110 and display unit 112 of FIG. 1, physical hand 614 is analogous to physical hand 114A or physical hand 114B of FIG. 1, etc.

FIGS. 6A and 6B represent top-down views of physical hand 614. FIG. 6A shows physical hand 614 in a stowed position and FIG. 6B shows physical hand 614 in an un-stowed position. In other words, in FIG. 6A, physical hand 614 appears as it would if a user of computing device 610 was viewing physical hand 614 presenting the time of day when obscuring a display region of the screen of display unit 612. In FIG. 6B, physical hand 614 appears as it would if a user of computing device 610 was viewing physical hand 614 when in a stowed position and no longer presenting the time of day.

FIGS. 6A and 6B show that, in some examples, each physical hand from the set of physical watch includes a respective planar surface and a respective vertical edge. For example, physical hand 614 includes planar surface 680 and vertical edge 682. The width w of planar surface 680 is greater than the depth or thickness d of vertical edge 682.

Computing device 610 may manipulate physical hand 614 by twisting physical hand 614 such that planar surface 680 is parallel to the screen of display unit 612 in response to determining that computing device 610 is operating in a time display mode. Alternatively, computing device 610 may manipulate physical hand 614 by twisting physical hand 614 such that planar surface 680 is perpendicular to the screen of display unit 612 in response to determining that computing device 610 is not operating in the time display mode. In some examples, vertical edge 682 of physical hand 614 has a thickness or depth d that causes the physical hand 614 to not obscure the screen of display unit 612 when physical hand 614 is twisted such that planar surface 680 is perpendicular to the screen. In other words, since the thickness d of physical hand 614 is so thin, to a user, physical hand 614 disappears from view and does not obscure graphical information presented at display unit 612 when planar surface 680 is perpendicular to the screen of display unit 612.

Figure 7:
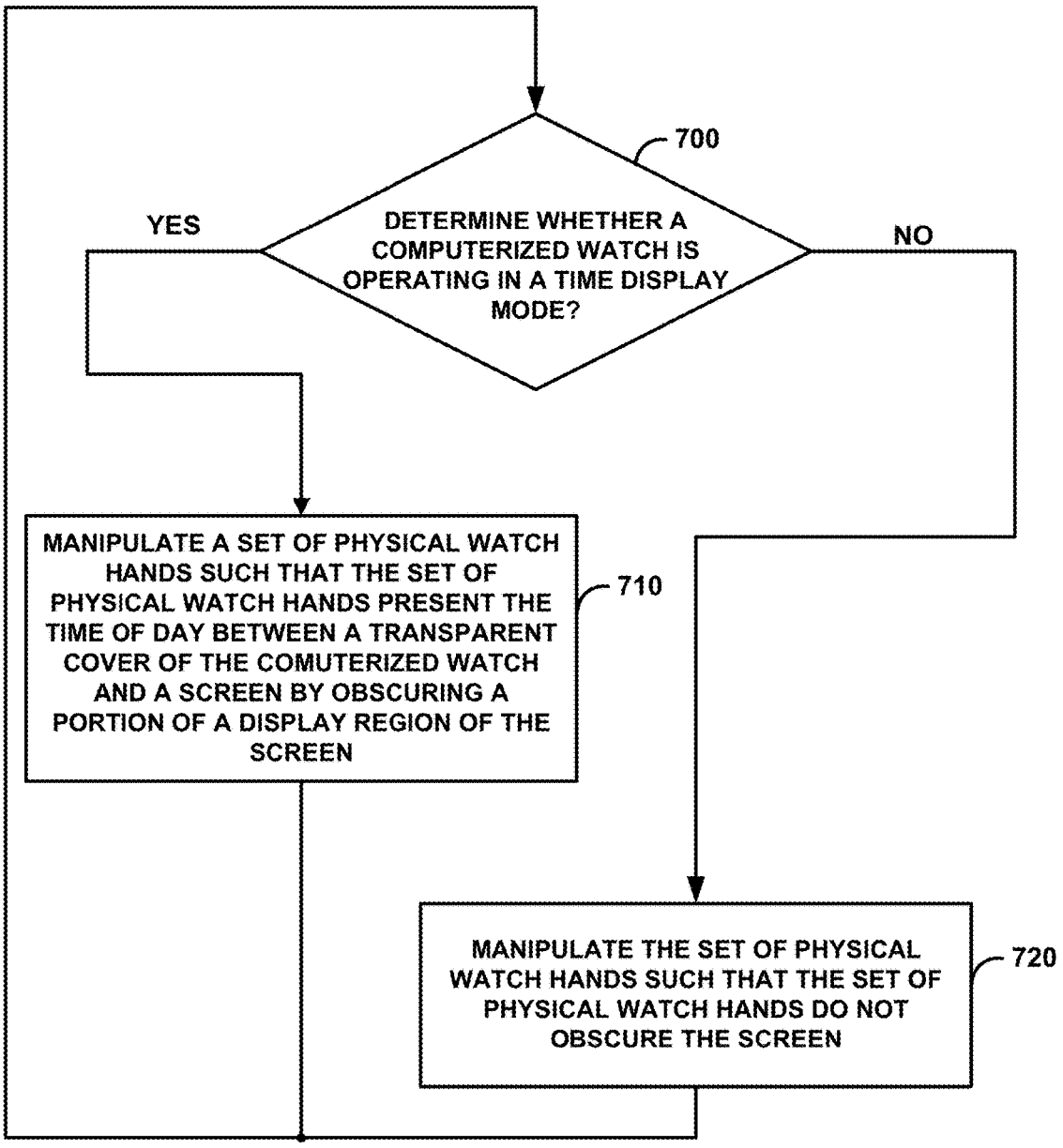
FIG. 7 is a flowchart illustrating example operations of an example computerized watch that is configured to present the time using physical watch hands, in accordance with one or more aspects of the present disclosure.

FIG. 7 is a flowchart illustrating example operations 700-720 of an example computerized watch that is configured to present the time using physical watch hands, in accordance with one or more aspects of the present disclosure. For example, in some instances, at least one processor of computing device 110 of FIG. 1 may cause UI module 120 to perform operations 700-720. In some examples, a computer-readable storage medium of computing device 110 may include instructions that, when executed, cause at least one processor of computing device 110 to perform operations 700-720. The flow chart of FIG. 7 represents one example ordering for operations 700-720. In other examples, an example computing device such as computing device 110 may perform operations 700-720 in a different order. FIG. 7 is described below in the context of computing device 110 of FIG. 1.

In operation, computing device 110 may determine whether a computerized watch is operating in a time display mode (700). For example, UI module 120 may detect, based on information obtained from a sensor of computing device 110, a pattern of movement associated with computing device 110. Based on the pattern of movement, UI module 120 may determine whether a user of computing device 110 is holding computing device 110 in a way that suggests he or she is viewing graphical information presented by display unit 112. Responsive to determining the user is not likely viewing graphical information presented at display unit 112, UI module 120 may cause computing device 110 to operate in a time display mode in which computing device 110 ceases presenting graphical information at display unit 112. Alternatively, responsive to determining the user is likely viewing graphical information presented at display unit 112, UI module 120 may cause computing device 110 to not operate in a time display mode but rather operate in a different mode in which computing device 110 presents graphical information at display unit 112.

Responsive to determining that computing device 110 is operating in the time display mode (YES branch, 700), computing device 110 may manipulate a set of physical watch hands such that the set of physical watch hands present the time of day between a transparent cover of the computerized watch and a screen by obscuring a portion of a display region of the screen (710). For example, UI module 120 may control an electrical and/or physical component of computing device 110 that is configured to manipulate physical watch hands 114A and 114B such that physical watch hands 114A and 114B present the time of day by obscuring a portion of a display region of display unit 212. UI module 120 may cause the electrical and/or physical watch hand components to manipulate physical hands 114 such that they change from being in a stowed position to an un-stowed position for presenting the time of day. For example, UI module 120 may cause physical hands 114 to extend from a retracted or stowed position to an extended position out over a portion of the display region of display unit 112 to present the time of day. In some examples, UI module 120 may cause physical hands 114 to twist from a concealed position in which a very thin (e.g., less than one millimeter) and substantially planar surface of physical hands 114 is perpendicular to the display region of display unit 112 to an un-concealed position in which the substantially planar surface of physical hands 114 is parallel, and partially obscures, the display region of display unit 112.

In some examples, further responsive to determining that the computerized watch is operating in the time display mode, UI module 120 may cause computing device 110 to refrain from outputting, for display at the screen of display unit 112, graphical information. In some examples, UI module 120 may cause computing device 110 to refrain from outputting the graphical information for display by powering-off the screen of display unit 112.

Responsive to determining that computing device 110 is not operating in the time display mode (NO branch, 700), computing device 110 may manipulate a set of physical watch hands such that the set of physical watch hands do not obscure the screen (720). For example, UI module 120 may detect, based on information obtained from a sensor of computing device 110, a pattern of movement associated with computing device 110 and determine, based on the pattern of movement, that a user of computing device 110 is holding or otherwise interacting with computing device 110 in such a way that he or she is likely to be viewing graphical information presented by display unit 112.

UI module 120 may cause computing device 110 to cease operating in the time display mode in which case, UI module 220 may cause display unit 112 to power-on or otherwise resume presenting graphical information using display unit 112. Said differently, UI module 120 may cause display unit 112 to output, for display at a screen of display unit 112, graphical information.

UI module 120 may cause the electrical and/or mechanical watch hand components of computing device 110 to manipulate physical hands 114 such that they change from being in an un-stowed position to a stowed position where physical hands 114 no longer obscure the screen of display unit 112. For example, UI module 220 may cause physical hands to retract from an extended position to a retracted position in the center of or beneath the display region of the screed of display unit 112. In some examples, UI module 120 may cause physical hands 114 to twist from an unconcealed position in which a substantially planar surface of physical hands 114 is parallel to the display region of display unit 112 to a concealed position in which the substantially planar surface of physical hands 114 is perpendicular to the screen, and due to the very small thickness of physical hands 114, does not visibly obscure the display region of display unit 112.

Figure 8A:
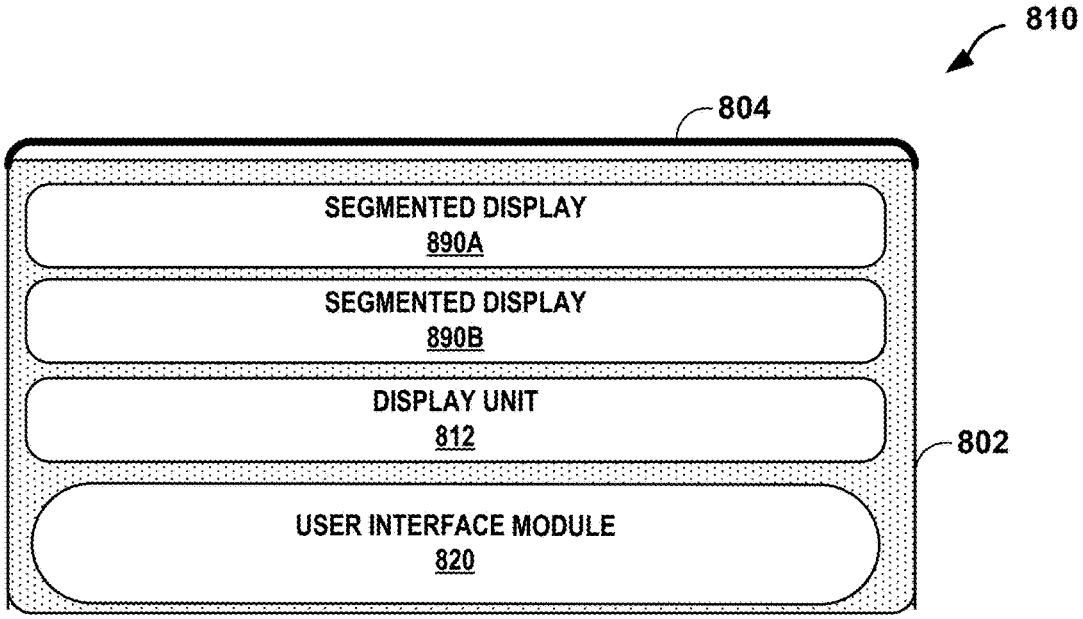
FIGS. 8A-8D are conceptual diagrams illustrating top-down and cross-sectional side views of an example computerized watch that is configured to present the time using multiple, layered segmented displays, in accordance with one or more aspects of the present disclosure.
Figure 8B:
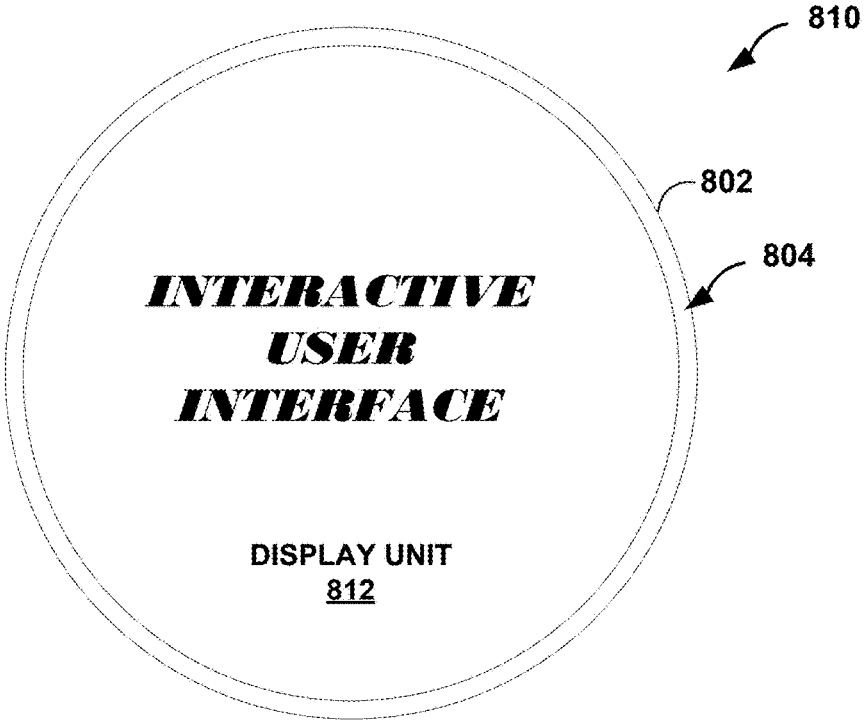

FIGS. 8A-8D are conceptual diagrams illustrating top-down and cross-sectional side views of computing device 810 as an example computerized watch that is configured to present the time using multiple, layered segmented displays, in accordance with one or more aspects of the present disclosure. Computing device 810 includes transparent cover 804, external housing 802, UI module 820, and display unit 812, which are similar to cover 104, housing 801, UI module 120, and display unit 812 of computing device 110 of FIG. 1. Instead of physical hands 114 however, computing device 810 includes a plurality of segmented displays 890A and 890B (collectively "segmented displays 890") layered atop display unit 812. Although only two segmented displays 890 are shown in FIGS. 8A and 8B, it should be understood that computing device 810 may include additional (e.g., more than two) segmented displays layered atop display unit 812.

Each of segmented displays 890 may, in some examples, be a segmented liquid crystal display (LCD) unit that is configured to present graphical watch hands (e.g., with each having sixty individual radial segments to display each second/minute and/or hour/minute) when computing device 810 is operating in a time display mode.

Figure 8C:
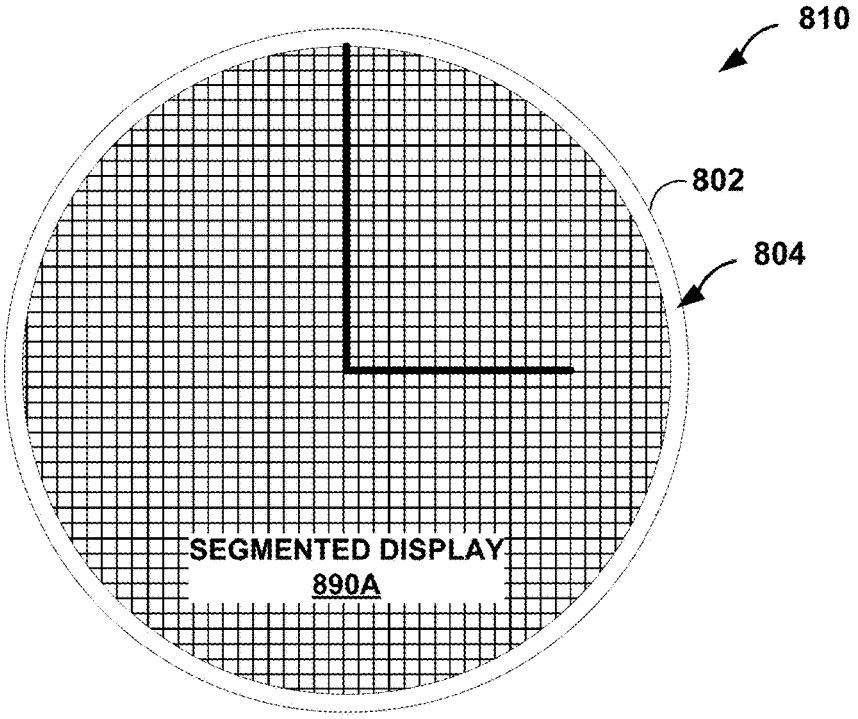
Figure 8D:
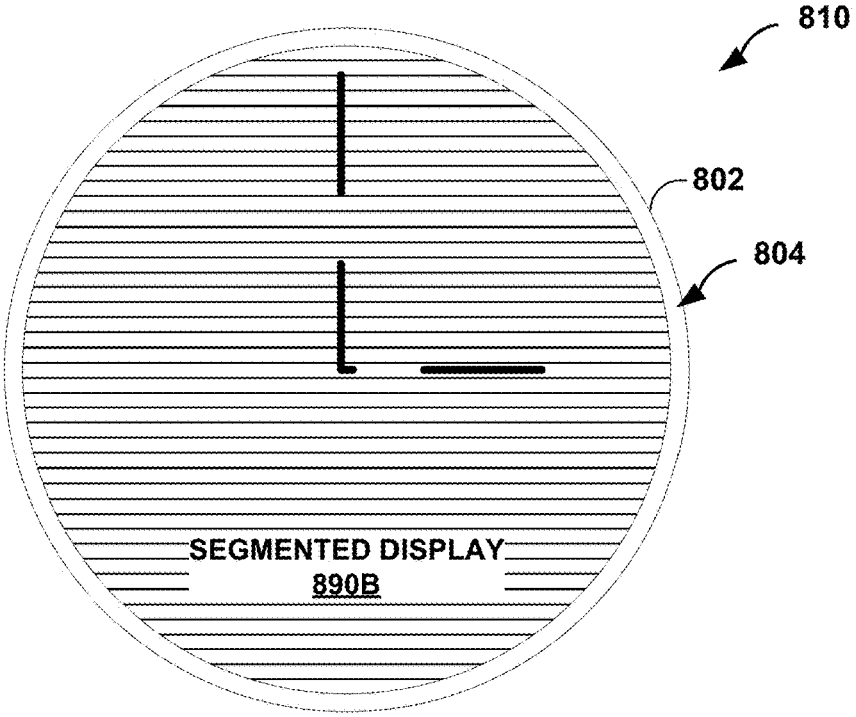

In some examples, each of segmented displays 890 may be configured to present a different style of a graphical watch face. UI module 820 may control each of segmented displays 890 and display unit 812 such that only one of segmented displays 890 or display unit 812 is active at any time. For example, as shown in FIG. 8B, when computing device 810 is not operating in a time display mode, UI module 820 may power-off or otherwise cause each of segmented displays 890 to be transparent and may cause display unit 812 to output graphical information for display. As shown in FIG. 8C, when computing device 810 is operating in a first time display mode in which computing device 810 is configured to present a first graphical watch face, UI module 820 may power-off display unit 812 and power-off display 890B and cause display 890A to display a first graphical watch face. As shown in FIG. 8D, when computing device 810 is operating in a second time display mode in which computing device 810 is configured to present a second graphical watch face that is different than the first graphical watch face, UI module 820 may power-off display unit 812 and power-off or otherwise cause display 890A to be transparent while simultaneously causing display 890B to display a second graphical watch face.

In some examples, computing device 810 may have a control (either mechanical or through a GUI maintained by UI module 820) that allows a user to select which watch face to display when operating in a time display mode. In this way, computing device 810 may rely on a segmented display to present the time of day rather than a more sophisticated and power hungry display unit that is also used to present a GUI. That is, segmented displays 890 may consume far less power to drive sixty LCD segments than display unit 812 which may have more than sixty LCD segments or rely on some other display technology.

Some individuals like watches with mechanical/physical hands because they are very precise and accurate at keeping time. Yet certain individuals also want smart watches that typically have displays dense with pixels that can be used to display arbitrary information like email, exercise activity, etc. Certain traditional computerized watches may have a single segmented LCD display layered above a general purpose full color, pixel-dense display. Such a segmented LCD may sit about the general purpose display, and by turning one of the displays on or off, these computerized watches may alternate between presenting the time and presenting a more sophisticated GUI.

Unlike other computerized watches and other computing devices, an example computing device, as described herein, may have mechanical watch hands to display the time of day that coexists with a general purpose pixel display. In some examples, the computing device may rely on mechanical hands that twist ninety degrees when the pixel display is active to be virtually invisible. In some examples, the mechanical hands may retract when in active mode and may extend when in time display mode. In other examples, an example computing device, as described herein may include one or more segmented LCD displays for presenting a graphical image of watch hands when operating in time display mode and may make the segmented LCD display transparent and use the general purpose display to present a GUI when not in time display mode. In one or more of these examples, the graphical or physical watch hands appear above the pixel display and use various techniques (e.g., rotation to the low profile form, turning off LCD, retraction) to remove their occlusion (blockage) of the pixel display below. In this way, unlike a traditional smart watch, the example computing device may be able to display the time (and maybe month, day, or other radially-communicated information) even when the pixel display is turned off. As pixel displays require a lot of power to keep running, even low-power mode or always on displays, the example computing device, either with physical or mechanical hands or a device with segmented LCDs, particularly with hands that may only need movement or updating once a minute, can operate using potentially only a fraction of the amount of power consumed by a traditional pixel LCD/OLED's display.

Clause 1. A computerized watch, comprising: a transparent cover that forms at least a portion of an outer surface of the computerized watch; a screen configured to output graphical information for display; a set of physical watch hands configured to present a time of day between the transparent cover and the screen; one or more computer processors; and a memory comprising instructions that when executed by the one or more computer processors cause the one or more computer processors to: responsive to determining that the computerized watch is operating in a time display mode, manipulate the set of physical watch hands such that the set of physical watch hands present the time of day by obscuring a portion of a display region of the screen; and responsive to determining that the computerized watch is not operating in the time display mode, manipulate the set of physical watch hands such that the set of physical hands do not obscure the screen.

Clause 2. The computerized watch of clause 1, wherein: the set of physical watch hands are configured to extend from a stowed position to an extended position to present the time of day between the cover and the screen; and the instructions, when executed, further cause the one or more computer processors to: manipulate the set of physical watch hands by extending the set of physical watch hands from the stowed position to the extended position in response to determining that the computerized watch is operating in the time display mode; and manipulate the set of physical watch hands by retracting the watch hands from the extended position to the stowed position in response to determining that the computerized watch is not operating in the time display mode.

Clause 3. The computerized watch of clause 2, wherein the stowed position corresponds to a central location of the display region of the screen that is between the cover and the screen.

Clause 4. The computerized watch of clause 3, further comprising a central hub located between the cover and the screen, wherein the stowed position is within the central hub.

Clause 5. The computerized watch of any one of clauses 2-4, wherein: the outer surface is a first surface of the computerized watch, the computerized watch further comprises an outer housing that forms a second surface of the computerized watch that is opposite the first surface; and the stowed position is located between the screen and the outer housing.

Clause 6. The computerized watch of clause 5, wherein the set of physical watch hands is configured to extend from the stowed position to the extended position by extending from an edge of the display region of the screen to the extended position above the display region of the screen.

Clause 7. The computerized watch of any one of clauses 5-6, further comprising a hub located between the edge of the screen and the outer housing, wherein the stowed position is within the hub.

Clause 8. The computerized watch of any of clauses 1-7, wherein: each physical hand from the set of physical watch includes a respective planar surface and a respective vertical edge; and the instructions, when executed, further cause the one or more computer processors to: manipulate the set of physical watch hands by twisting each physical watch hand of the set of physical watch hands such that the respective planar surface is parallel to the screen in response to determining that the computerized watch is operating in the time display mode; and manipulate the set of physical watch hands by twisting each physical hand such that the respective planar surface is perpendicular to the screen in response to determining that the computerized watch is not operating in the time display mode.

Clause 9. The computerized watch of clause 8, wherein the respective vertical edge of each physical hand from the set of physical watch hands has a thickness that causes the set of physical watch hands to not obscure the screen when the set of physical watch hands are twisted such that the respective planar surface is perpendicular to the screen.

Clause 10. The computerized watch of any of clauses 1-9, wherein the set of physical watch hands is formed from metallic material, composite material, silicon material, or polymer material.

Clause 11. The computerized watch of any of clauses 1-10, wherein the set of physical watch hands is formed of a spring steel.

Clause 12. A method comprising: responsive to determining that a computerized watch is operating in a time display mode, manipulating, by the computerized watch, a set of physical watch hands such that the set of physical watch hands present a time of day between a cover of the computerized watch and a screen of the computerized watch by obscuring a portion of a display region of the screen, wherein the cover forms at least a portion of an outer surface of the computerized watch; and responsive to determining that the computerized watch is not operating in the time display mode, manipulating, by the computerized watch, the set of physical watch hands such that the set of physical hands do not obscure the screen.

Clause 13. The method of clause 12, further comprising: further responsive to determining that the computerized watch is not operating in the time display mode, outputting, by the computerized watch, for display at the screen, graphical information.

Clause 14. The method of any of clauses 12-13, further comprising: further responsive to determining that the computerized watch is operating in the time display mode, refraining from outputting, by the computerized watch, for display at the screen, graphical information.

Clause 15. The method of clause 14, wherein refraining from outputting the graphical information includes powering-off, by the computerized watch, the screen.

Clause 16. The method of any of clauses 12-15, wherein manipulating the set of physical watch hands such that the set of physical watch hands present the time of day between the cover and the screen comprises extending, by the computerized watch, the watch hands from a stowed position to an extended position in response to determining that the computerized watch is operating in the time display mode.

Clause 17. The method of clause 16, wherein the stowed position and the extended position are each located between the cover and the screen.

Clause 18. The method of claim 16, wherein the extended position is located between the cover and the screen and the stowed position is located between the screen and an outer housing that forms a surface of the computerized watch that is opposite the cover.

Clause 19. A computer readable storage medium comprising instructions, that when executed, cause at least one processor of a computerized watch to: responsive to determining that a computerized watch is operating in a time display mode, manipulate a set of physical watch hands of the computerized watch such that the set of physical watch hands present a time of day between a cover of the computerized watch and a screen of the computerized watch by obscuring a portion of a display region of the screen, wherein the cover forms at least a portion of an outer surface of the computerized watch; and responsive to determining that the computerized watch is not operating in the time display mode, manipulate set of physical watch hands such that the set of physical hands do not obscure the screen.

Clause 20. The computer readable storage medium of clause 19, wherein each physical hand includes from the set of physical watch hands includes a respective planar surface and a respective vertical edge, and the instructions, when executed, further cause the at least one processor of the computerized watch to: manipulate the set of physical watch hands such that the set of physical watch hands present the time of day between the cover and the screen by twisting each physical hand from the set of physical watch hands such that a respective planar surface of the physical hand is parallel to the screen in response to determining that the computerized watch is operating in the time display mode; manipulate the set of physical watch hands such that the set of physical hands do not obscure the screen by twisting each physical hand from the set of physical watch hands such that the respective planar surface is perpendicular to the screen in response to determining that the computerized watch is not operating in the time display mode.

Clause 21. A system comprising means for performing any of the methods of clauses 12-18.

Clause 21. The computing device of clause 1, comprising one or more computer processors and a memory comprising instructions that when executed cause the one or more computer processors to perform any of the methods of clauses 12-18.

In one or more examples, the functions described may be implemented in hardware, software, firmware, or any combination thereof If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media, which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperable hardware units, including one or more processors as described above, in conjunction with suitable software and/or firmware.

Various examples have been described. These and other examples are within the scope of the following claims.

What is claimed is:

1. A computerized watch, comprising:

a transparent cover that forms at least a portion of an outer surface of the computerized watch;

a screen configured to output graphical information for display;

a set of physical watch hands configured to present a time of day between the transparent cover and the screen; and one or more computer processors configured to:

determine whether the computerized watch is operating in a time display mode;

responsive to determining that the computerized watch is operating in the time display mode, manipulate a respective length of each physical hand from the set of physical watch hands such that the set of physical watch hands present the time of day; and responsive to determining that the computerized watch is not operating in the time display mode, manipulate the respective length of each physical hand from the set of physical watch hands such that the set of physical hands do not present the time of day.

2. The computerized watch of claim 1, wherein the one or more computer processors are configured to:

responsive to determining that the computerized watch is operating in the time display mode, manipulate the set of physical watch hands such that the set of physical watch hands present the time of day by obscuring a portion of a display region of the screen; and responsive to determining that the computerized watch is not operating in the time display mode, manipulate the set of physical watch hands such that the set of physical hands do not present the time of day by not obscuring the portion of the display region of the screen.

3. The computerized watch of claim 2, wherein: the set of physical watch hands are configured to extend from a stowed position to an extended position to present the time of day between the cover and the screen and the one or more computer processors are further configured to manipulate the set of physical watch hands by extending the set of physical watch hands from the stowed position to the extended position in response to determining that the computerized watch is operating in the time display mode.

4. The computerized watch of claim 3, wherein the stowed position corresponds to a central location of the display region of the screen that is between the cover and the screen.

5. The computerized watch of claim 3, the one or more computer processors are further configured to manipulate the set of physical watch hands by retracting the watch hands from the extended position to the stowed position in response to determining that the computerized watch is not operating in the time display mode.

6. The computerized watch of claim 3, further comprising a central hub located between the cover and the screen, wherein the stowed position is within the central hub.

7. The computerized watch of claim 3, wherein: the outer surface is a first surface of the computerized watch, the computerized watch further comprises an outer housing that forms a second surface of the computerized watch that is opposite the first surface; and the stowed position is located between the screen and the outer housing.

8. The computerized watch of claim 3, wherein the set of physical watch hands is configured to extend from the stowed position to the extended position by extending from an edge of the display region of the screen to the extended position above the display region of the screen.

9. The computerized watch of claim 8, further comprising a hub located between the edge of the screen and the outer housing, wherein the stowed position is within the hub.

10. The computerized watch of claim 1, wherein:

each physical hand from the set of physical watch includes a respective planar surface and a respective vertical edge; and the one or more computer processors are further configured to:

manipulate the set of physical watch hands by twisting each physical watch hand of the set of physical watch hands such that the respective planar surface is parallel to the screen in response to determining that the computerized watch is operating in the time display mode; and manipulate the set of physical watch hands by twisting each physical hand such that the respective planar surface is perpendicular to the screen in response to determining that the computerized watch is not operating in the time display mode.

11. The computerized watch of claim 10, wherein the respective vertical edge of each physical hand from the set of physical watch hands has a thickness that causes the set of physical watch hands to not obscure the screen when the set of physical watch hands are twisted such that the respective planar surface is perpendicular to the screen.

12. The computerized watch of claim 1, wherein the set of physical watch hands is formed from metallic material, composite material, silicon material, polymer material; or a spring steel.

13. A method comprising:

determining whether a computerized watch is operating in a time display mode; and responsive to determining that the computerized watch is operating in the time display mode, manipulating, by the computerized watch, a respective length of each physical hand from a set of physical watch hands such that the set of physical watch hands present a time of day between a cover of the computerized watch and a screen of the computerized watch, wherein the cover forms at least a portion of an outer surface of the computerized watch; and responsive to determining that the computerized watch is not operating in the time display mode, manipulating, by the computerized watch, the respective length of each physical hand from the set of physical watch hands such that the set of physical hands do not display the time of day.

14. The method of claim 13, further comprising:

responsive to determining that the computerized watch is operating in the time display mode, manipulating, by the computerized watch, the set of physical watch hands such that the set of physical watch hands present the time of day by obscuring a portion of a display region of the screen; and responsive to determining that the computerized watch is not operating in the time display mode, manipulating, by the computerized watch, the set of physical watch hands such that the set of physical hands do not present the time of day by not obscuring the portion of the display region of the screen.

15. The method of claim 14, wherein the set of physical watch hands are configured to extend from a stowed position to an extended position to present the time of day between the cover and the screen, and manipulating the set of physical watch hands comprises extending the set of physical watch hands from the stowed position to the extended position in response to determining that the computerized watch is operating in the time display mode.

16. The method of claim 15, wherein the stowed position corresponds to a central location of the display region of the screen that is between the cover and the screen.

17. The method of claim 15, wherein manipulating the set of physical watch hands comprises retracting the watch hands from the extended position to the stowed position in response to determining that the computerized watch is not operating in the time display mode.

18. The method of claim 15, wherein the computerized watch comprises a central hub located between the cover and the screen, wherein the stowed position is within the central hub.

19. The method of claim 15, wherein: the outer surface is a first surface of the computerized watch, the computerized watch further comprises an outer housing that forms a second surface of the computerized watch that is opposite the first surface; and the stowed position is located between the screen and the outer housing.

20. A computer readable storage medium comprising instructions, that when executed, cause at least one processor of a computerized watch to:

determine whether a computerized watch is operating in a time display mode; and responsive to determining that the computerized watch is operating in the time display mode, manipulate a respective length of each physical hand from a set of physical watch hands such that the set of physical watch hands present a time of day between a cover of the computerized watch and a screen of the computerized watch, wherein the cover forms at least a portion of an outer surface of the computerized watch; and responsive to determining that the computerized watch is not operating in the time display mode, manipulate the respective length of each physical hand from the set of physical watch hands such that the set of physical hands do not display the time of day.

* * * * *